US012796883B2

(12) United States Patent
Jasper et al.

(10) Patent No.: US 12,796,883 B2
(45) Date of Patent: Nov. 17, 2026

(54) ROBOTIC CLEANER WITH EXTENDABLE CLEANING SURFACE

(71) Applicant: SharkNinja Operating LLC, Needham, MA (US)

(72) Inventors: Evan Paul Jasper, Whitman, MA (US); Scott C. Teuscher, Advance, NC (US)

(73) Assignee: SharkNinja Operating LLC, Needham, MA (US)

( * ) Notice: Subject to any disclaimer, the term of this patent is extended or adjusted under 35 U.S.C. 154(b) by 16 days.

(21) Appl. No.: 18/819,766

(22) Filed: Aug. 29, 2024

(65) Prior Publication Data

US 2025/0072693 A1 Mar. 6, 2025

Related U.S. Application Data

(60) Provisional application No. 63/535,419, filed on Aug. 30, 2023.

(51) Int. Cl.
*A47L 11/40* (2006.01)

(52) U.S. Cl.
CPC ..... *A47L 11/4036* (2013.01); *A47L 11/4011* (2013.01); *A47L 11/4061* (2013.01); *A47L 11/4069* (2013.01); *A47L 11/4091* (2013.01); *A47L 2201/02* (2013.01); *A47L 2201/04* (2013.01); *A47L 2201/06* (2013.01)

(58) Field of Classification Search
CPC .... A47L 9/28; A47L 11/4069; A47L 11/4011; A47L 11/40
See application file for complete search history.

(56) References Cited

U.S. PATENT DOCUMENTS

| | | | | |
|---|---|---|---|---|
| 7,346,428 | B1 * | 3/2008 | Huffman | A47L 11/4011 701/301 |
| 7,448,113 | B2 * | 11/2008 | Jones | A47L 9/0411 15/360 |
| 11,199,853 | B1 * | 12/2021 | Afrouzi | G05D 1/0246 |
| 2004/0034954 | A1 | 2/2004 | Morita et al. | |
| 2013/0078149 | A1 * | 3/2013 | Holmes | B04B 13/00 494/9 |
| 2013/0221908 | A1 * | 8/2013 | Tang | B25J 19/005 320/107 |
| 2014/0081504 | A1 * | 3/2014 | Smith | B63B 17/00 114/221 R |
| 2019/0320859 | A1 * | 10/2019 | Bofill | E04G 23/002 |
| 2019/0368507 | A1 * | 12/2019 | Xu | F04D 29/444 |
| 2021/0204684 | A1 * | 7/2021 | Heman-Ackah | A47L 11/4041 |
| 2022/0400925 | A1 * | 12/2022 | Hoobler | A47L 11/28 |

(Continued)

FOREIGN PATENT DOCUMENTS

| | | |
|---|---|---|
| FR | 1329729 A | 6/1963 |
| GB | 748107 | 4/1956 |

(Continued)

*Primary Examiner* — Michael D Jennings
(74) *Attorney, Agent, or Firm* — The Webb Law Firm

(57) ABSTRACT

Systems, methods, and computer program products for a robotic cleaner with an extendable cleaning surface are provided. An example robotic cleaning system may include a robotic cleaner having a housing and a cleaning pad movably attached to the housing. The cleaning pad may be movable to extend at least a portion of the cleaning pad beyond an edge of the housing.

11 Claims, 18 Drawing Sheets

(56) References Cited

U.S. PATENT DOCUMENTS

| | | | | |
|---|---|---|---|---|
| 2023/0113195 | A1* | 4/2023 | Thomas | A47L 9/2826 15/347 |
| 2023/0190062 | A1* | 6/2023 | VanTongeren | A47L 9/2873 15/3 |
| 2023/0248192 | A1* | 8/2023 | Brown | A47L 5/22 15/320 |
| 2024/0016356 | A1* | 1/2024 | Ding | A47L 11/4088 |

FOREIGN PATENT DOCUMENTS

| | | |
|---|---|---|
| GB | 783612 | 9/1957 |
| JP | 2005213785 A | 8/2005 |

* cited by examiner

ROBOTIC CLEANER WITH EXTENDABLE CLEANING SURFACE

CROSS-REFERENCE TO RELATED APPLICATION

This application claims priority to U.S. Provisional Patent Application No. 63/535,419, filed Aug. 30, 2023, the disclosure of which is hereby incorporated by reference in its entirety.

BACKGROUND

Field

This disclosure relates generally to automated cleaning apparatuses and, in some non-limiting embodiments or aspects, to robotic cleaners with extendable cleaning surfaces.

Technical Considerations

Robotic floor cleaners provide convenient, automated cleaning processes in various consumer and commercial settings. Such robotic floor cleaners typically operate with one or more sensors detecting and/or contacting nearby walls or other obstacles, which causes the robotic cleaner to change course to continue the cleaning process. In order to prevent or minimize scuffing or other contact abrasion with walls or furniture, robotic cleaners may be configured to operate within a follow distance or buffer spacing the path of the robotic cleaner from a detected wall or obstacle. This buffer space can define an area that is not cleaned by the robotic cleaner.

In addition, certain robotic cleaners equipped for wet cleaning operations include a wet cleaning element (e.g., a mop pad, squeegee edge, or the like) on a portion thereof. For some robotic cleaners, the wet cleaning element may have a width less than the widest point or diameter of the robotic cleaner, resulting in an additional space or portion of the travel path of the robotic cleaner that is not cleaned or treated by the wet cleaning element. This untreated portion of the travel path can compound with the wall or obstacle buffer space discussed above to result in an undesirable amount of surface area that is not cleaned by the robotic cleaner.

SUMMARY

The present disclosure provides robotic cleaning systems, devices, and methods of use thereof that reduce or eliminate surface areas that remain untreated or not cleaned after a robotic cleaning process.

According to non-limiting embodiments or aspects, a robotic cleaning system is provided. An example system may include a robotic cleaner having a housing and a cleaning pad movably attached to the housing. The cleaning pad may be movable to extend at least a portion of the cleaning pad beyond an edge of the housing.

In some non-limiting embodiments or aspects, the robotic cleaner may include a motor coupled to the housing. The motor may be configured to move the cleaning pad with respect to the housing. The robotic cleaner may include a rotor coupled to the motor and the cleaning pad. Rotational movement of the rotor may cause linear movement of the cleaning pad.

In some non-limiting embodiments or aspects, the cleaning pad may define a groove on a surface thereof, and the groove may be configured to receive a portion of the rotor therein. The cleaning pad may be movable in a substantially linear direction along a first axis with respect to the housing. The groove may define an elongated length substantially perpendicular to the first axis.

In some non-limiting embodiments or aspects, the robotic cleaner may include a biasing element attached to the cleaning pad. The biasing element may be configured to bias the cleaning pad towards a first position with respect to the housing. The cleaning pad may be releasably attached to the housing.

In some non-limiting embodiments or aspects, the robotic cleaner may include at least one sensor and at least one processor. The at least one processor may be programmed or configured to detect an obstacle based on information from the at least one sensor and actuate movement of the cleaning pad with respect to the housing. The at least one processor may be programmed or configured to actuate movement of the robotic cleaner in response to detecting an obstacle.

In some non-limiting embodiments or aspects, the at least one processor may be programmed or configured to actuate movement of the cleaning pad with respect to the housing after actuating movement of the robotic cleaner in response to detecting an obstacle. The at least one processor may be programmed or configured to actuate movement of the cleaning pad by sending a signal to a motor coupled to the cleaning pad.

In some non-limiting embodiments or aspects, the robotic cleaning system may include a docking station having a base and a support extending laterally from the base. The support may be configured to receive at least a portion of the robotic cleaner on top of the support.

In some non-limiting embodiments or aspects, a method of operating a robotic cleaner is provided. An example method may include positioning the robotic cleaner on a surface such that a cleaning pad coupled to the robotic cleaner contacts the surface and moving the cleaning pad from a first position where the cleaning pad is substantially aligned a housing of the robotic cleaner to a second position where at least a portion of the cleaning pad laterally extends away from the housing.

In some non-limiting embodiments or aspects, moving the cleaning pad from the first position to the second position may include moving the cleaning pad along a substantially linear path. Moving the cleaning pad from the first position to the second position may be performed while the cleaning pad is in contact with the surface.

In some non-limiting embodiments or aspects, the method may include detecting, with at least one sensor coupled to the housing, an obstacle on the surface and moving the cleaning pad from the first position to the second position based on the detection of the obstacle.

In some non-limiting embodiments or aspects, the method may include moving the robotic cleaner based on the detection of the obstacle. Moving the cleaning pad may include moving the cleaning pad from the first position to the second position after moving the robotic cleaner.

In some non-limiting embodiments or aspects, the method may include retracting the cleaning pad from the second position to the first position and repeatedly moving the cleaning pad at least partially between the first and second positions while the robotic cleaner is stationary.

In some non-limiting embodiments or aspects, the method may include at least one of releasably attaching the cleaning pad to the housing, detaching the cleaning pad from the housing, or any combination thereof.

In some non-limiting embodiments or aspects, a computer program product is provided. An example computer program product may include at least one non-transitory computer-readable medium including program instructions that, when executed by at least one processor, cause the at least one processor to perform any of the methods described herein.

Further non-limiting embodiments or aspects will be set forth in the following numbered clauses:

Clause 1: A robotic cleaning system, comprising: a robotic cleaner comprising: a housing; and a cleaning pad movably attached to the housing, the cleaning pad being movable to extend at least a portion of the cleaning pad beyond an edge of the housing.

Clause 2: The system of clause 1, wherein the robotic cleaner further comprises a motor coupled to the housing, the motor configured to move the cleaning pad with respect to the housing.

Clause 3: The system of clause 1 or clause 2, wherein the robotic cleaner further comprises a rotor coupled to the motor and the cleaning pad, wherein rotational movement of the rotor causes linear movement of the cleaning pad.

Clause 4: The system of any of clauses 1-3, wherein the cleaning pad defines a groove on a surface thereof, the groove configured to receive a portion of the rotor therein.

Clause 5: The system of any of clauses 1-4, wherein the cleaning pad is movable in a substantially linear direction along a first axis with respect to the housing, and wherein the groove defines an elongated length substantially perpendicular to the first axis.

Clause 6: The system of any of clauses 1-5, wherein the robotic cleaner further comprises a biasing element attached to the cleaning pad, the biasing element configured to bias the cleaning pad towards a first position with respect to the housing.

Clause 7: The system of any of clauses 1-6, wherein the cleaning pad is releasably attached to the housing.

Clause 8: The system of any of clauses 1-7, wherein the robotic cleaner further comprises: at least one sensor; and at least one processor programmed or configured to: detect an obstacle based on information from the at least one sensor; and actuate movement of the cleaning pad with respect to the housing.

Clause 9: The system of any of clauses 1-8, wherein the at least one processor is programmed or configured to actuate movement of the robotic cleaner in response to detecting an obstacle.

Clause 10: The system of any of clauses 1-9, wherein the at least one processor is programmed or configured to actuate movement of the cleaning pad with respect to the housing after actuating movement of the robotic cleaner in response to detecting an obstacle.

Clause 11: The system of any of clauses 1-10, wherein the at least one processor is programmed or configured to actuate movement of the cleaning pad by sending a signal to a motor coupled to the cleaning pad.

Clause 12: The system of any of clauses 1-11, further comprising: a docking station comprising: a base; and a support extending laterally from the base, the support configured to receive at least a portion of the robotic cleaner on top of the support.

Clause 13: A method of operating a robotic cleaner, comprising: positioning the robotic cleaner on a surface such that a cleaning pad coupled to the robotic cleaner contacts the surface; and moving the cleaning pad from a first position where the cleaning pad is substantially aligned with a housing of the robotic cleaner to a second position where at least a portion of the cleaning pad laterally extends away from the housing.

Clause 14: The method of clause 13, wherein moving the cleaning pad from the first position to the second position includes moving the cleaning pad along a substantially linear path.

Clause 15: The method of clause 13 or clause 14, wherein moving the cleaning pad from the first position to the second position is performed while the cleaning pad is in contact with the surface.

Clause 16: The method of any of clauses 13-15, further comprising: detecting, with at least one sensor coupled to the housing, an obstacle on the surface; and moving the cleaning pad from the first position to the second position based on the detection of the obstacle.

Clause 17: The method of any of clauses 13-16, further comprising: moving the robotic cleaner based on the detection of the obstacle, wherein moving the cleaning pad comprises moving the cleaning pad from the first position to the second position after moving the robotic cleaner.

Clause 18: The method of any of clauses 13-17, further comprising: retracting the cleaning pad from the second position to the first position; and repeatedly moving the cleaning pad at least partially between the first and second positions while the robotic cleaner is stationary.

Clause 19: The method of any of clauses 13-18, further comprising at least one of releasably attaching the cleaning pad to the housing, detaching the cleaning pad from the housing, or any combination thereof.

Clause 20: A computer program product comprising at least one non-transitory computer-readable medium including program instructions that, when executed by at least one processor, cause the at least one processor to perform the method of any of clauses 13-19.

These and other features and characteristics of the present disclosure, as well as the methods of operation and functions of the related elements of structures and the combination of parts and economics of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the present disclosure. As used in the specification and the claims, the singular form of "a," "an," and "the" include plural referents unless the context clearly dictates otherwise.

BRIEF DESCRIPTION OF THE DRAWINGS

Additional advantages and details of the disclosure are explained in greater detail below with reference to the exemplary embodiments or aspects that are illustrated in the accompanying schematic figures, in which.

DESCRIPTION

Figure 1A:
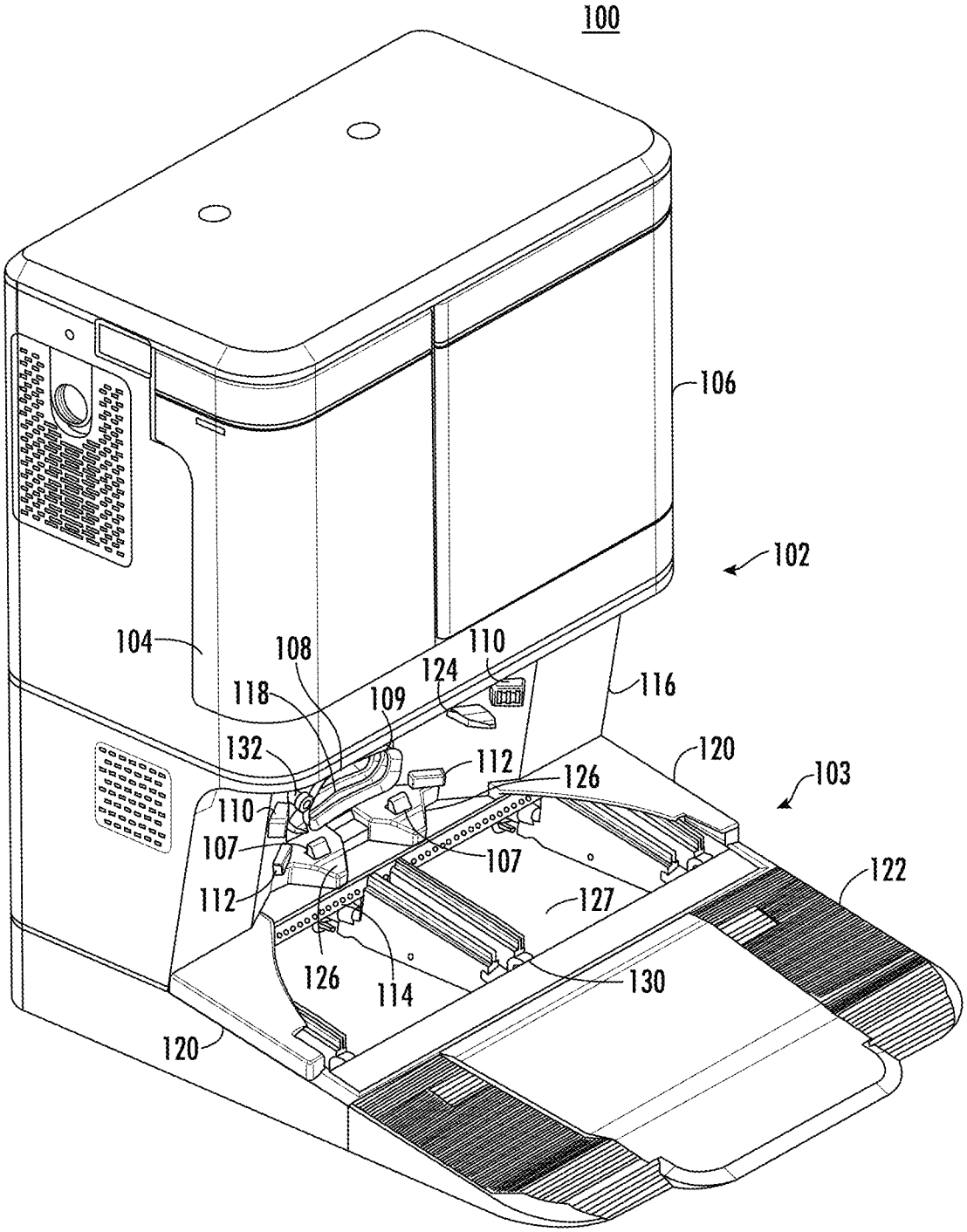
FIG. 1A is a front perspective view of a docking station, according to non-limiting embodiments or aspects of the present disclosure.

For purposes of the description hereinafter, the terms "upper", "lower", "right", "left", "vertical", "horizontal", "top", "bottom", "lateral", "longitudinal," and derivatives thereof shall relate to non-limiting embodiments or aspects as they are oriented in the drawing figures. However, it is to be understood that non-limiting embodiments or aspects may assume various alternative variations and step sequences, except where expressly specified to the contrary. It is also to be understood that the specific devices and processes illustrated in the attached drawings, and described in the following specification, are simply exemplary embodiments or aspects. Hence, specific dimensions and other physical characteristics related to the embodiments or aspects disclosed herein are not to be considered as limiting.

No aspect, component, element, structure, act, step, function, instruction, and/or the like used herein should be construed as critical or essential unless explicitly described as such. Also, as used herein, the articles "a" and "an" are intended to include one or more items and may be used interchangeably with "one or more" and "at least one." Furthermore, as used herein, the term "set" is intended to include one or more items (e.g., related items, unrelated items, a combination of related and unrelated items, etc.) and may be used interchangeably with "one or more" or "at least one." Where only one item is intended, the term "one" or similar language is used. Also, as used herein, the terms "has," "have," "having," or the like are intended to be open-ended terms. Further, the phrase "based on" is intended to mean "based at least partially on" unless explicitly stated otherwise. The phase "based on" may also mean "in response to" where appropriate.

Some non-limiting embodiments or aspects are described herein in connection with thresholds. As used herein, satisfying a threshold may refer to a value being greater than the threshold, more than the threshold, higher than the threshold, greater than or equal to the threshold, less than the threshold, fewer than the threshold, lower than the threshold, less than or equal to the threshold, equal to the threshold, and/or the like.

As used herein, the term "communication" may refer to the reception, receipt, transmission, transfer, provision, and/or the like of data (e.g., information, signals, messages, instructions, commands, and/or the like). For one unit (e.g., a device, a system, a component of a device or system, combinations thereof, and/or the like) to be in communication with another unit means that the one unit is able to directly or indirectly receive information from and/or transmit information to the other unit. This may refer to a direct or indirect connection (e.g., a direct communication connection, an indirect communication connection, and/or the like) that is wired and/or wireless in nature. Additionally, two units may be in communication with each other even though the information transmitted may be modified, processed, relayed, and/or routed between the first and second unit. For example, a first unit may be in communication with a second unit even though the first unit passively receives information and does not actively transmit information to the second unit. As another example, a first unit may be in communication with a second unit if at least one intermediary unit processes information received from the first unit and communicates the processed information to the second unit.

As used herein, the term "computing device" may refer to one or more electronic devices configured to process data. A computing device may, in some examples, include the necessary components to receive, process, and output data, such as a processor, a display, a memory, an input device, a network interface, and/or the like. A computing device may be a mobile device. As an example, a mobile device may include a cellular phone (e.g., a smartphone or standard cellular phone), a portable computer, a wearable device (e.g., watches, glasses, lenses, clothing, and/or the like), a personal digital assistant (PDA), and/or other like devices. A computing device may also be a desktop computer or other form of non-mobile computer.

As used herein, the term "server" may refer to or include one or more computing devices that are operated by or facilitate communication and processing for multiple parties in a network environment, such as the internet, although it will be appreciated that communication may be facilitated over one or more public or private network environments and that various other arrangements are possible. Further, multiple computing devices (e.g., servers, desktop computers, mobile devices, etc.) directly or indirectly communicating in the network environment may constitute a "system." Reference to "a server" or "a processor," as used herein, may refer to a previously recited server and/or processor that is recited as performing a previous step or function, a different server and/or processor, and/or a combination of servers and/or processors. For example, as used in the specification and the claims, a first server and/or a first processor that is recited as performing a first step or function may refer to the same or different server and/or a processor recited as performing a second step or function.

The systems, devices, and methods described herein provide numerous technical advantages in systems for cleaning using robotic cleaners, including robotic cleaners equipped for wet mode operation.

Figure 1B:
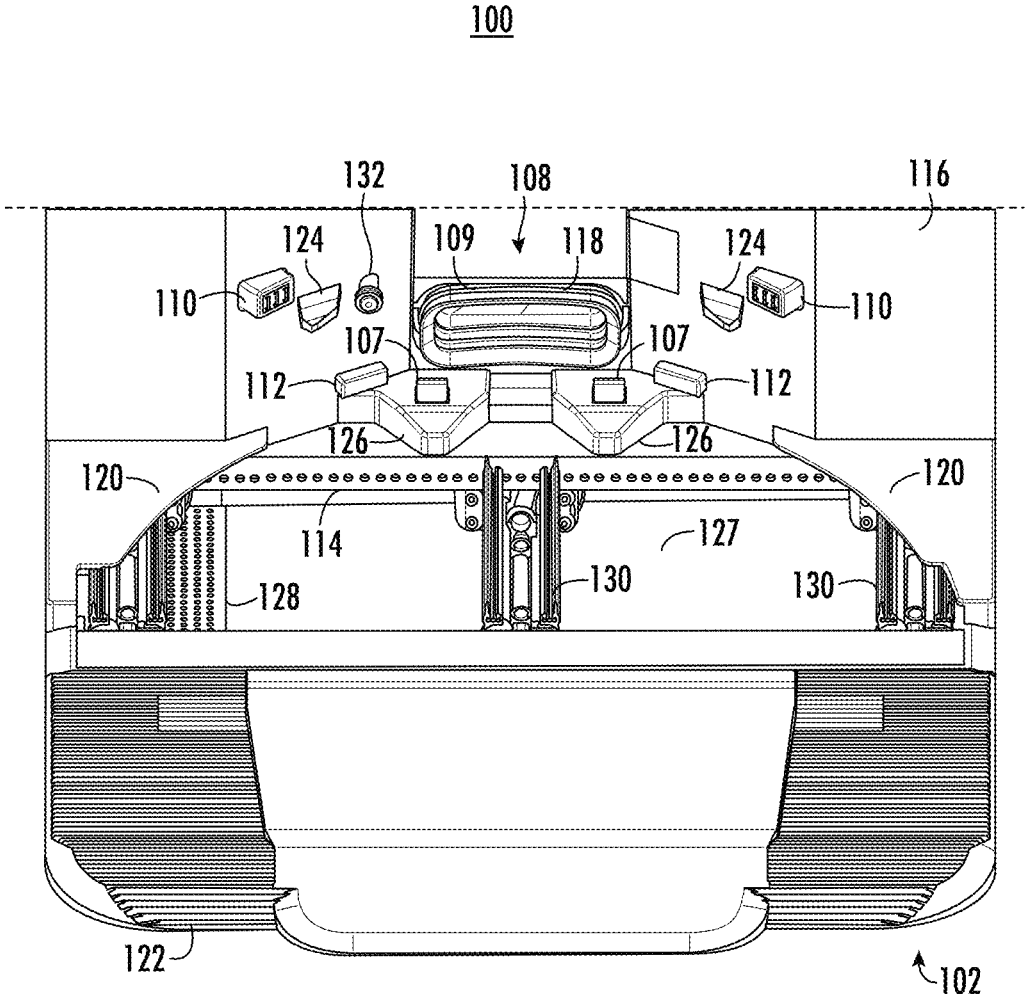
FIG. 1B is a front and top-angle view of a lower portion of a docking station, according to non-limiting embodiments or aspects of the present disclosure.
Figure 1C:
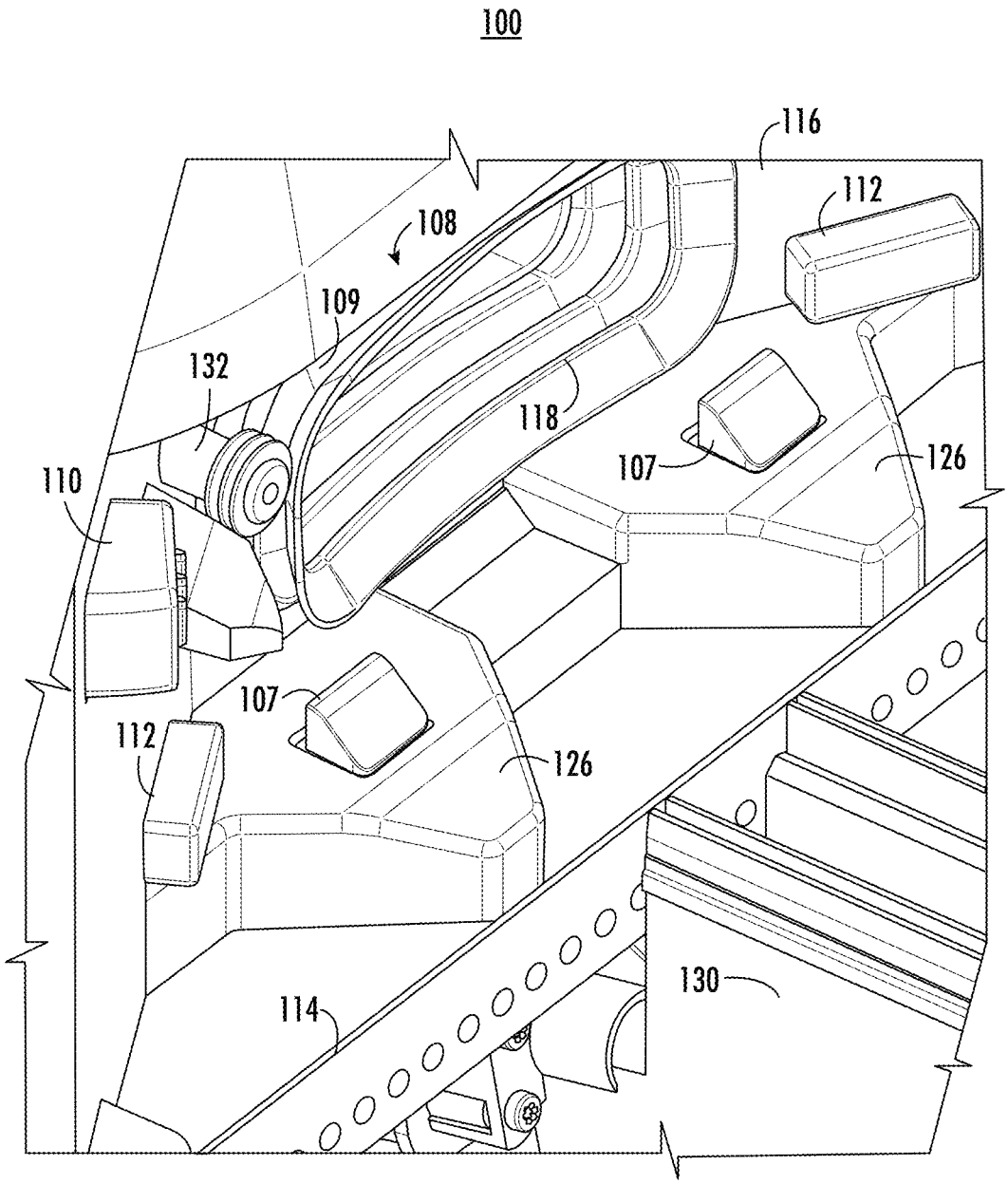
FIG. 1C is a front perspective view of a lower portion of a docking station, including a close-up view of FIG. 1A, according to non-limiting embodiments or aspects of the present disclosure.

Referring now to FIGS. 1A-1C, FIG. 1A-1C are views of docking station 100, according to non-limiting embodiments or aspects of the present disclosure. In particular, FIG. 1A is a front perspective view of a complete docking station 100. FIG. 1B is a front and top-angle view of the lower base 102 and support 103 of docking station 100. FIG. 1C is a front perspective view of docking station 100, including a close-up of a portion of the view of FIG. 1A. Exemplary features of docking station 100 may be described in relation to exemplary features of robotic cleaner 300, which is further shown and described in connection with FIGS. 2A-2C and 3B-3K.

In some non-limiting embodiments or aspects, docking station 100 may include base 102 forming a housing. Base 102 may include internal components for emptying and refilling robotic cleaner 300 when robotic cleaner 300 is docked with docking station 100. For example, base 102 may include an upper portion for housing a cleaning fluid tank 104, where new cleaning fluid may be loaded into cleaning fluid tank 104 for storage. New cleaning fluid may be delivered into robotic cleaner 300 from cleaning fluid tank 104 via cleaning fluid conduit 132. Additionally or alternatively, new cleaning fluid may be delivered to wash basin 127 from cleaning fluid tank 104 via internal cleaning fluid conduit 132. Cleaning fluid tank 104 may be removably coupled to base 102. Docking station 100 may include debris tank 106, which may be removably coupled to base 102 to allow debris tank 106 to be cleaned and emptied. Debris tank 106 may be configured to collect wet and/or dry debris collected by robotic cleaner 300 during a cleaning operation. Debris tank 106 may be filled with debris via, at least partly, docking station suction inlet 108.

Figure 2A:
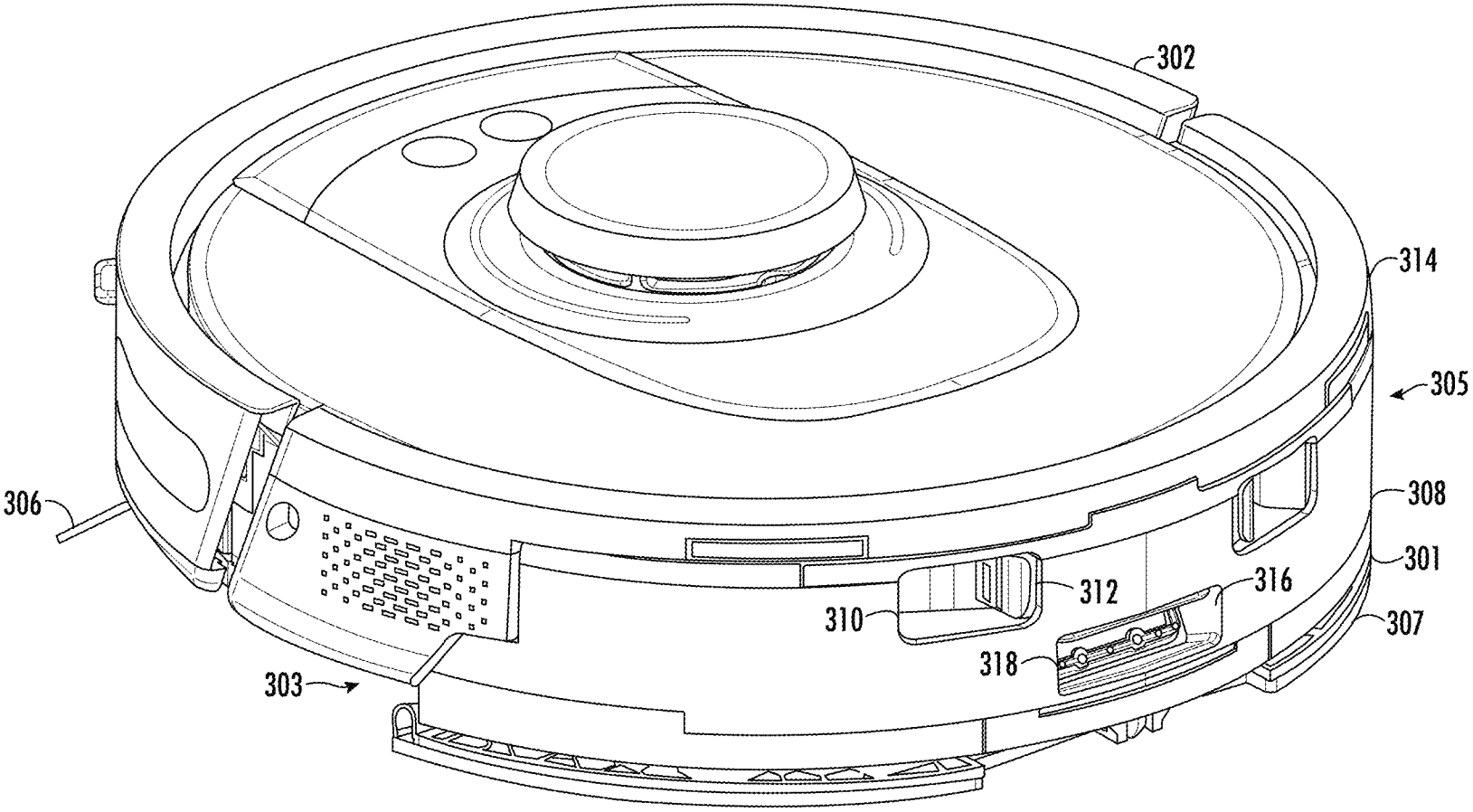
FIG. 2A is a rearward perspective view of a robotic cleaner, according to non-limiting embodiments or aspects of the present disclosure.

Docking station 100 may include support 103 and/or suction housing 116, which may extend from support 103 to form the bottom of base 102. Suction housing 116 may enclose at least one suction motor used to create an inflow of air via docking station suction inlet 108. Suction housing 116 may further include an internal conduit to convey debris from robotic cleaner 300 to debris tank 106. Suction housing 116 may further define docking station suction inlet 108. Docking station suction inlet 108 may be configured to fluidly couple to at least a portion of robotic cleaner 300 such that at least a portion of debris stored within debris cup 308 of robotic cleaner 300 may be urged through docking station suction inlet 108 and into debris tank 106. For example, and as shown in FIG. 2A, debris cup 308 of robotic cleaner 300 may include outlet port 316 configured to fluidly couple to docking station suction inlet 108. Support 103 may be configured to improve the stability of docking station 100 on a surface to be cleaned (e.g., a floor). Support 103 may be further configured to hold at least one wet cleaning element 301 (e.g., a plate configured with a mop pad) of robotic cleaner 300 while robotic cleaner 300 is in a dry mode of operation (e.g., dry vacuuming). Charging contacts 110 may be included at the lower portion of base 102 and/or may be configured to electrically couple to robotic cleaner 300 such that one or more energy storage components (e.g., batteries) powering robotic cleaner 300 may be recharged. For example, power may be conveyed to robotic cleaner 300 via charging contacts 110 from a power supply that is internal or external to docking station 100 (e.g., a power outlet to which docking station 100 is plugged).

When robotic cleaner 300 seeks to recharge one or more batteries and/or empty debris cup 308 of robotic cleaner 300, robotic cleaner 300 may enter a docking mode. When in the docking mode, robotic cleaner 300 may approach docking station 100 in a manner that allows robotic cleaner 300 to electrically couple to charging contacts 110 and fluidly couple outlet port 316 of robotic cleaner 300 to docking station suction inlet 108. For the purpose of illustration, when in docking mode, robotic cleaner 300 may move to align itself relative to docking station 100, such that robotic cleaner 300 may become docked with docking station 100. For example, when in docking mode, robotic cleaner 300 may approach docking station 100 in a forward direction of travel until reaching a predetermined distance from docking station 100, stop at the predetermined distance and rotate approximately 180°, and proceed in a rearward direction of travel until robotic cleaner 300 docks with docking station 100.

As shown, docking station 100 may include a boot 109 that extends around docking station suction inlet 108. Boot 109 may be configured to engage debris cup 308, such that boot 109 extends around outlet port 316. Boot 109 may be resiliently deformable, such that boot 109 generally conforms to a shape of debris cup 308 of robotic cleaner 300. As such, boot 109 may be configured to sealingly engage debris cup 308. For example, boot 109 may be made of a natural or synthetic rubber, a foam, and/or any other resiliently deformable material. Boot 109 may define one or more ribs 118. Ribs 118 are configured to expand and/or compress in response to robotic cleaner 300 engaging boot 109, allowing boot 109 to deform to accommodate the form of debris cup 308.

In some non-limiting embodiments or aspects, when robotic cleaner 300 is engaging docking station 100 in a misaligned orientation, robotic cleaner 300 may be configured to pivot in place according to an oscillatory pattern. By pivoting in place, robotic cleaner 300 may cause outlet port 316 of robotic cleaner 300 to align with boot 109, such that outlet port 316 is fluidly coupled to docking station suction inlet 108.

In some non-limiting embodiments or aspects, base 102 and/or support 103 may define one or more stops configured to engage a portion of robotic cleaner 300 when robotic cleaner 300 is docking with docking station 100. For example, base 102 may define lower docking stops 112 and upper docking stops 124. One or more stops 112, 124 may be configured to prevent further movement of robotic cleaner 300 toward docking station 100 when robotic cleaner 300 is docking with docking station 100. In some non-limiting embodiments or aspects, upper docking stops 124 may define a guide surface having a taper. For example, a plurality of stops may be provided, each having a tapered guide surface such that engagement of robotic cleaner 300 with the guide surfaces urges robotic cleaner 300 towards an aligned orientation.

In some non-limiting embodiments or aspects, support 103 may define a ramp 122 to allow robotic cleaner 300 to travel onto support 103 from a surface to be cleaned (e.g., a floor). Ramp 122 may include a surface configured to be non-slip for at least one drive wheel 304 of robotic cleaner 300, such as a textured or coated surface. Support 103 may further define a guide surface 120 configured as an apron extending from base 102 toward ramp 122. Guide surface 120 may be configured to engage with an outer edge of at least one wet cleaning element 301 of robotic cleaner 300, creating a generally fluid seal between the outer edge of at least one wet cleaning element 301 and support 103.

When robotic cleaner 300 is docked with docking station 100, at least one wet cleaning element 301 may form a cover over wash basin 127 of support 103. Wash basin 127 may define a cavity in support 103 that houses a shuttle rail 114 along which at least one cleaning shuttle 130 (e.g., including upward-facing sprayers, scrubbers, agitators, and/or the like) may translate back and forth (e.g., along shuttle rail 114) to clean at least one wet cleaning element 301, when robotic cleaner 300 is docked with docking station 100. Cleaning shuttle 130 may emit cleaning fluid from cleaning fluid tank 104 to clean at least one wet cleaning element 301. Used cleaning fluid, after being emitted from cleaning shuttle 130, may drip into wash basin 127 and be carried, by fluid flow and gravity, to wash basin drain 128. Wash basin drain 128 may be mechanically coupled with a pump (not shown) to empty wash basin 127 of used cleaning fluid. The used cleaning fluid may be carried, via conduit (e.g., tubing), from wash basin drain 128 to debris tank 106. At least one detent 107 further holds robotic cleaner 300 in place, via at least one wet cleaning element 301, to prevent robotic cleaner 300 from becoming dislodged during the cleaning process by cleaning shuttle 130.

In some non-limiting embodiments or aspects, at least a portion of the shuttle assembly (e.g., including shuttle rail 114 and cleaning shuttle 130) may be mechanically coupled to the at least one detent 107. In such a manner, at least one detent 107 may be configured to retract at least partly into the support 103 (e.g., detent housing 126) upon movement of the shuttle mechanism conveying cleaning shuttle 130 from a first position (e.g., directly underneath wet cleaning element 301) to a second position (e.g., tucked to the side of wash basin 127). For example, a connector (e.g., cable, armature, lever, etc.) may cause at least one detent 107 to retract when cleaning shuttle 130 has completed a cleaning cycle of at least one wet cleaning element 301 and move from an operational position to a non-operational position.

Docking station 100 may include at least one detent 107 extending vertically from support 103 (e.g., as shown, two detents 107). At least one detent 107 is configured to depress away from robotic cleaner 300 when at least a portion of robotic cleaner 300 (e.g., at least one wet cleaning element 301) travels over at least one detent 107 toward base 102 of docking station 100. When moving from a raised position to a depressed position, at least one detent 107 may recess into at least one detent housing 126. At least one detent housing 126 may include a cavity, into which at least one detent 107 may recess when being depressed. At least one detent housing 126 may further include a biasing mechanism (e.g., compression spring, torsion spring, elastomeric material, and/or the like) to urge at least one detent 107 back to a raised position when not opposed by a greater downward force. In some non-limiting embodiments or aspects, docking station 100 may include a plurality of detents 107, which may be mechanically coupled together at least partly within one or more detent housings 126. In such cases, movement of each detent 107 may be coupled such that each detent 107 raises or lowers together. At least one detent 107 may raise when at least a portion (e.g., engaging surface 320) of at least one wet cleaning element 301 of robotic cleaner 300 has passed over at least one detent 107. At least one detent 107 may contact at least a portion (e.g., engaging surface 320) of at least one wet cleaning element 301 when robotic cleaner 300 is docked with docking station 100.

Figure 2B:
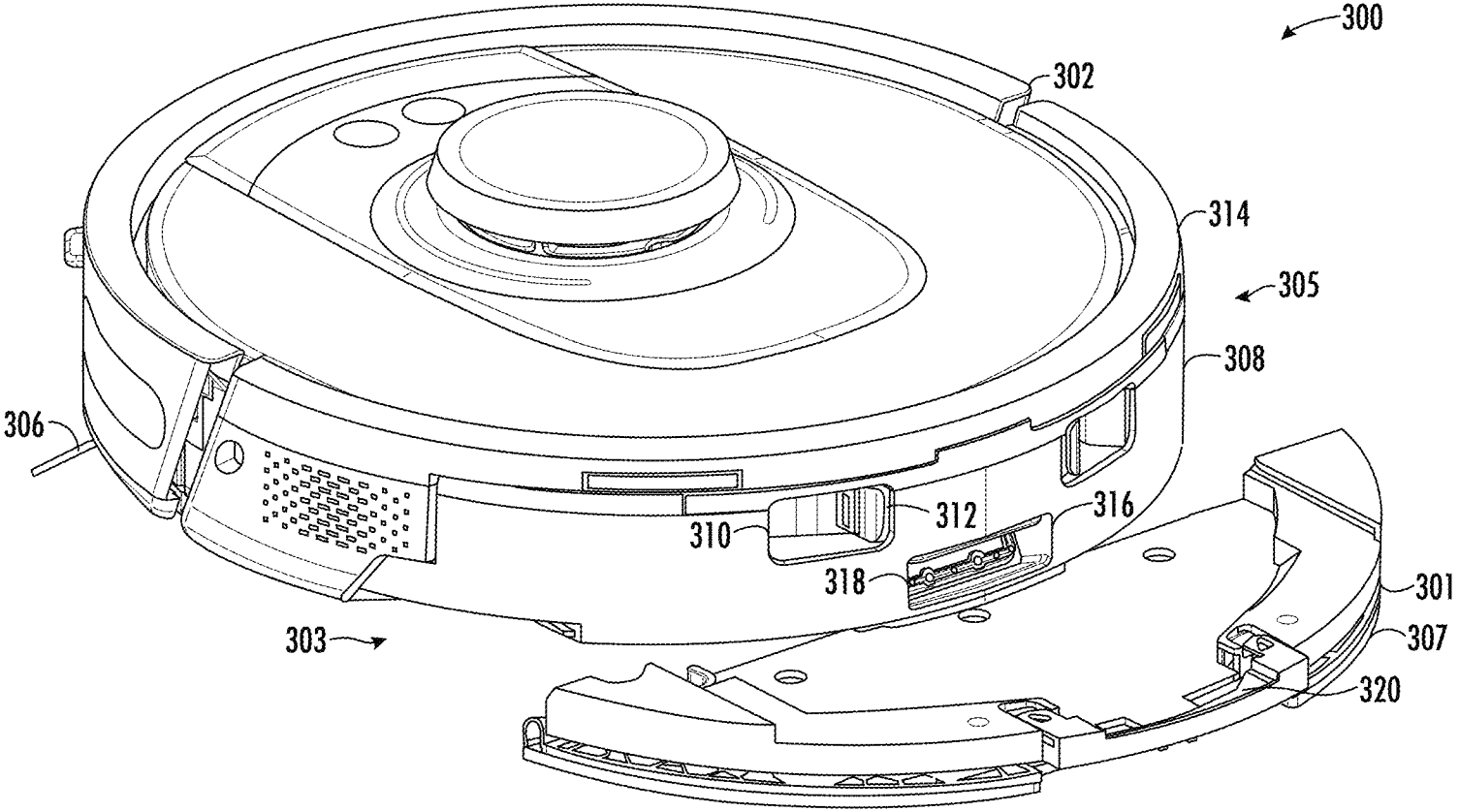
FIG. 2B is a rearward perspective view of a robotic cleaner, according to non-limiting embodiments or aspects of the present disclosure.
Figure 2C:
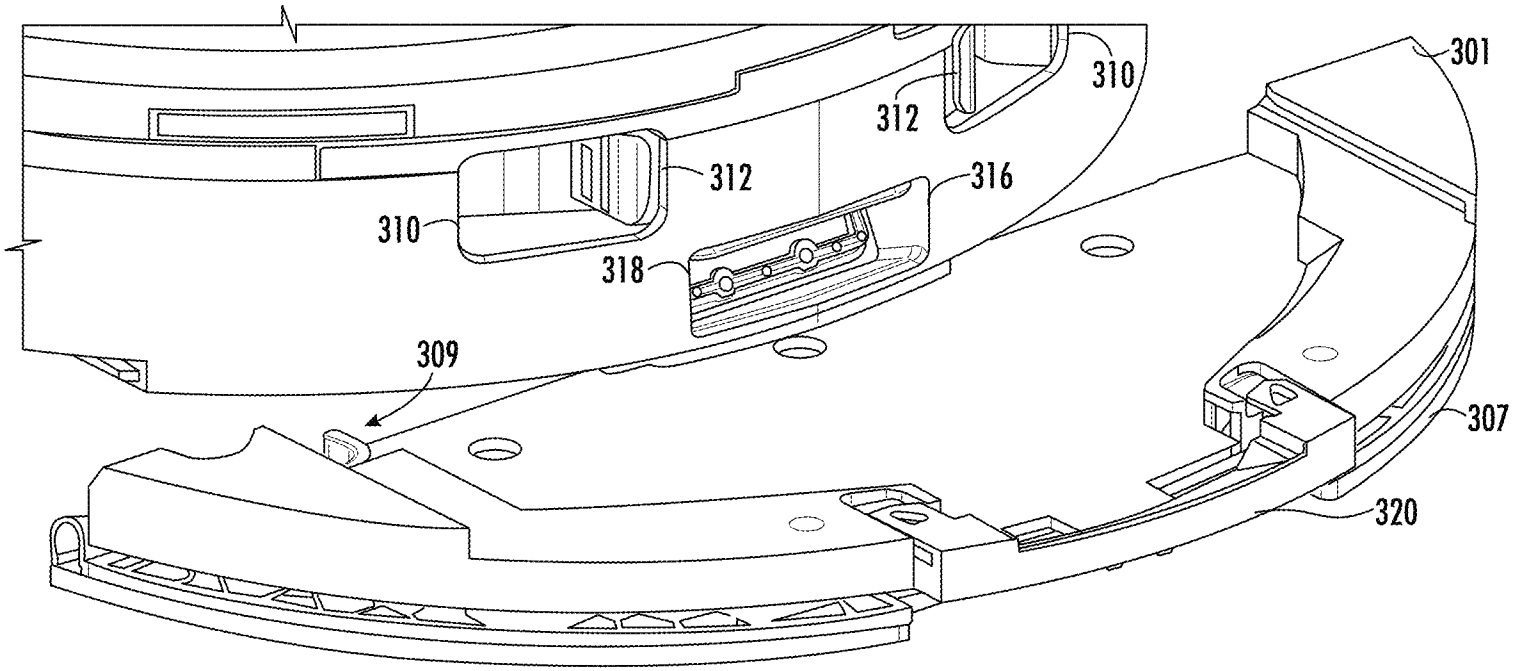
FIG. 2C is a rearward perspective view of a robotic cleaner, including a close-up view of FIG. 2B, according to non-limiting embodiments or aspects of the present disclosure.

Referring now to FIGS. 2A-2C, FIGS. 2A-2C are rearward perspective views of robotic cleaner 300, according to non-limiting embodiments or aspects of the present disclosure. FIG. 2A is a first rearward perspective view of robotic cleaner 300 with at least one wet cleaning element 301 attached to housing 305 of robotic cleaner 300. FIG. 2B is a second rearward perspective view of robotic cleaner 300 with at least one wet cleaning element 301 detached from housing 305 of robotic cleaner 300. FIG. 2C is a third rearward perspective view that is a close-up view of FIG. 2B, focusing on at least one wet cleaning element 301. As shown, robotic cleaner 300 includes at least one wet cleaning element 301 (e.g., having a releasable attachment 309), housing 303, displaceable bumper 302, at least one drive wheel 304 (not illustrated, represented in FIG. 6), side brush 306, debris cup 308, and outlet port 316. At least a portion of displaceable bumper 302 and debris cup 308 may be disposed on opposing sides of the at least one drive wheel. As such, displaceable bumper 302 may be positioned in a forward portion of robotic cleaner 300 and debris cup 308 may be positioned in a rearward portion of robotic cleaner 300.

As shown, robotic cleaner 300 includes a release 310 for debris cup 308 positioned between a top surface 314 of debris cup 308 and the outlet port 316. Release 310 may include opposing depressable triggers 312 configured to be actuated in opposing directions. Actuation of triggers 312 may cause at least a portion of debris cup 308 to disengage a portion of robotic cleaner 300 such that debris cup 308 may be removed therefrom.

Outlet port 316 may include an evacuation pivot door 318. Evacuation pivot door 318 may be configured to transition from an open position (e.g., when robotic cleaner 300 is docked with docking station 100) and a closed position (e.g., when robotic cleaner 300 is carrying out a cleaning operation). When transitioning to the closed position, evacuation pivot door 318 may pivot in a direction of debris cup 308. As such, during a cleaning operation, a suction force generated by a suction motor of robotic cleaner 300 may urge evacuation pivot door 318 toward the closed position. Additionally or alternatively, a biasing mechanism (e.g., a compression spring, a torsion spring, an elastomeric material, and/or any other biasing mechanism) may urge evacuation pivot door 318 toward the closed position. When transitioning to the open position, evacuation pivot door 318 may pivot in a direction away from debris cup 308. As such, when robotic cleaner 300 is docked with docking station 100, the suction generated by a suction motor of docking station 100 may urge evacuation pivot door 318 towards the open position.

At least one wet cleaning element 301 is detachably connected (e.g., using releasable attachment 309) to an underside 303 of housing 305 of robotic cleaner 300. Releasable attachments 309 usable for connecting wet cleaning element 301 to housing 305 may include, but are not limited to, friction clips, snug-fit adaptors, and/or the like. At least one wet cleaning element 301 includes an engaging surface 320 configured to contact at least one detent 107 when robotic cleaner 300 is docked with docking station 100. At least one wet cleaning element 301 may include at least one cleaning pad 307 (e.g., mop pad) that is configured to be imbued with a cleaning solution and contact a floor surface to be cleaned by robotic cleaner 300. At least one wet cleaning element 301 may be detached from housing 305 of robotic cleaner 300 by the action of being fixed in place by at least one detent 107, in combination with at least one drive wheel of robotic cleaner 300 causing robotic cleaner 300 to travel away from base 102 of docking station 100.

Figure 3A:
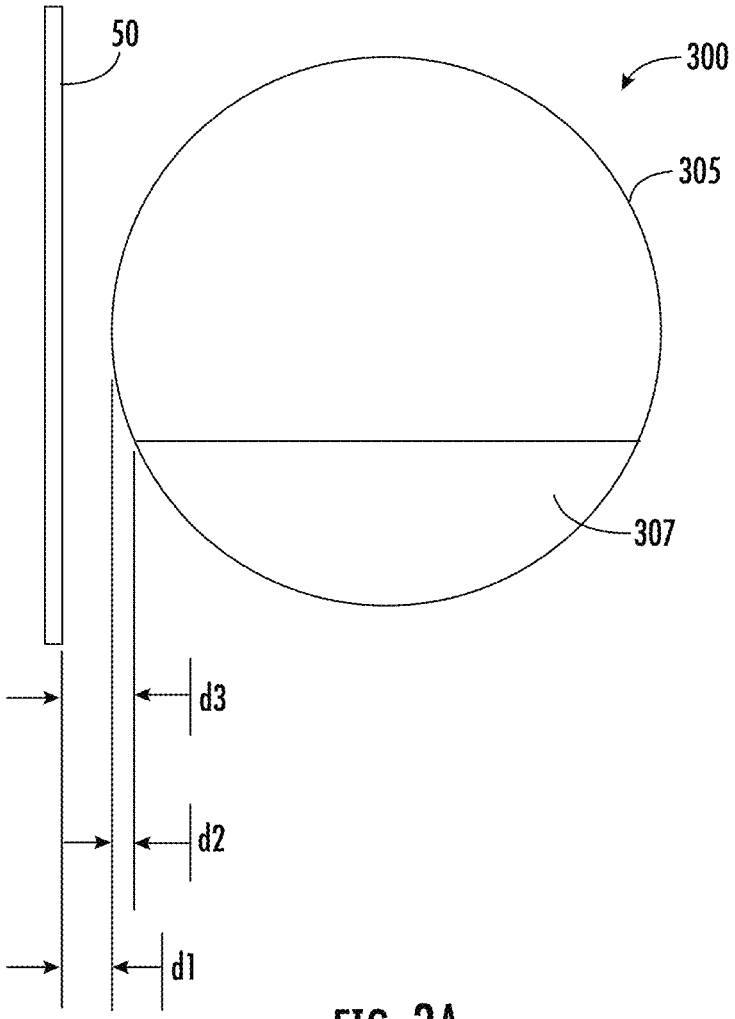
FIG. 3A is diagram of an example of a robotic cleaner in a cleaning environment, according to non-limiting embodiments or aspects of the present disclosure.
Figure 3B:
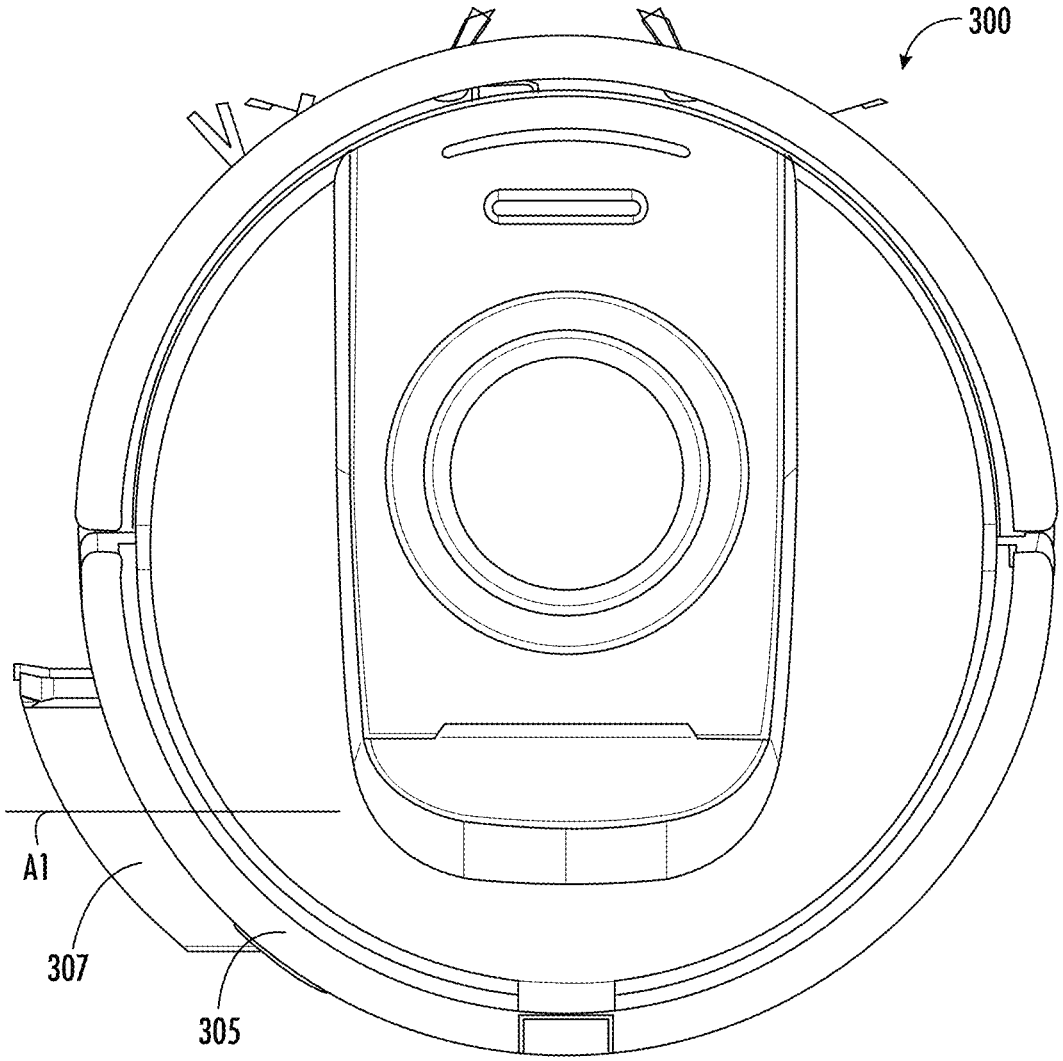
FIG. 3B is a top view of an example robotic cleaner, according to non-limiting embodiments or aspects of the present disclosure.
Figure 3C:
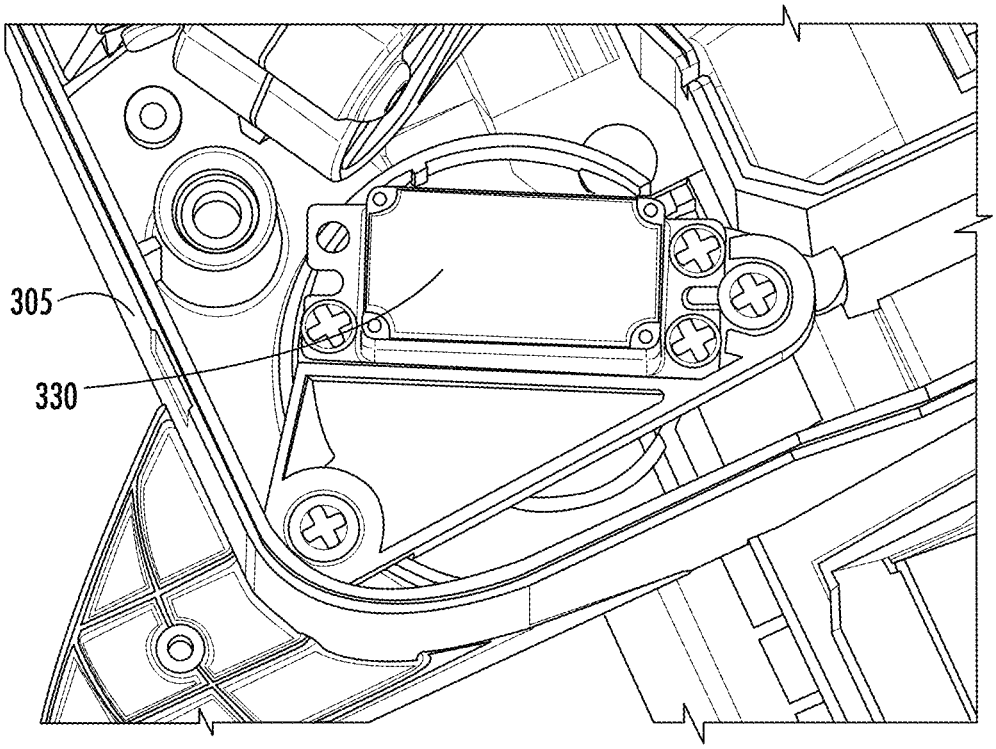
FIG. 3C is a partial assembly view of a portion of the robotic cleaner of FIG. 3B.
Figure 3D:
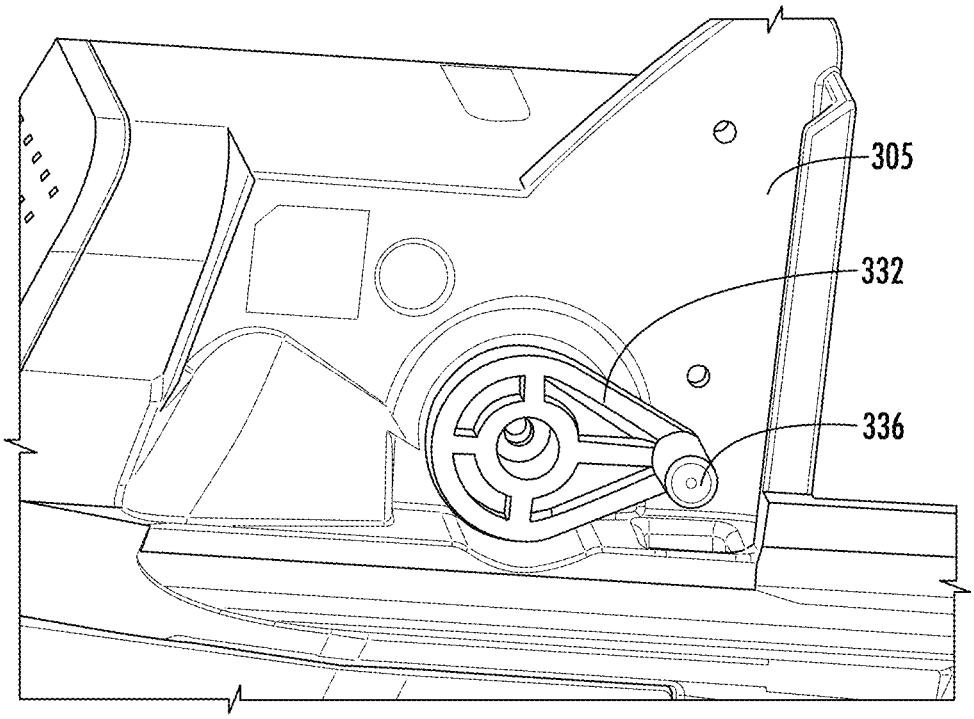
FIG. 3D is another partial assembly view of a portion of the robotic cleaner of FIG. 3B.

Referring now to FIG. 3A, FIG. 3A shows diagram of an example robotic cleaner in a cleaning environment, according to non-limiting embodiments or aspects of the present disclosure.

In some non-limiting embodiments or aspects, robotic cleaner 300 may maintain (e.g., be programmed or configured to maintain) a buffer space (e.g., wall follow distance d1) from an obstacle 50 (e.g., a wall, piece of furniture, an object, a boundary, and/or the like) detected by robotic cleaner 300. For example, wall follow distance d1 may be a preset and/or predefined distance (e.g., programmed into one more processors or controllers, as described herein) to minimize or reduce scuffing and/or abrasive contact between robotic cleaner 300 and obstacle 50. This wall follow distance d1 may create a surface portion that is not treated or cleaned by cleaning element 301 and/or cleaning pad 307 of robotic cleaner 300. In some non-limiting embodiments or aspects, cleaning element 301 and/or cleaning pad 307 may have a width less than the greatest width (e.g., diameter and/or the like) of housing 305 of robotic cleaner 300, and there may be an additional space having width d2 (e.g., within the travel path of robotic cleaner 300) that is not cleaned by cleaning element 301 and/or cleaning pad 307. In some non-limiting embodiments or aspects, wall follow distance d1 and width d2 may be combined to provide a total untreated surface width d3. In some non-limiting embodiments or aspects, robotic cleaner 300 may be configured to reduce (e.g., eliminate, minimize, and/or the like) the untreated surface width d3 (e.g., to increase the surface cleaned by robotic cleaner 300). For example, robotic cleaner 300 may include a cleaning pad 307 that is controllably (e.g., selectively and/or the like) movable (e.g., extendable and/or the like) beyond the housing 305, as described herein (e.g., as shown in FIGS. 3B-3K).

Referring now to FIGS. 3B-3K, FIGS. 3B-3K show views of an example robotic cleaner, according to non-limiting embodiments or aspects of the present disclosure. In some non-limiting embodiments or aspects, robotic cleaner 300 may include a cleaning pad 307 that is controllably (e.g., selectively and/or the like) movable (e.g., extendable and/or the like) beyond housing 305, for example, to expand the cleaning reach of robotic cleaner 300 (e.g., cleaning element 301 and/or cleaning pad 307 thereof). In some non-limiting embodiments or aspects, cleaning pad 307 may extend and retract in a substantially linear path along a first axis A1.

In some non-limiting embodiments or aspects, to enable motion (e.g., selective extension and/or retraction of cleaning pad 307), robotic cleaner 300 may include motor 330 attached to and/or included within and/or on housing 305, and motor 330 may be configured and/or operable to rotate rotor 332. For example, rotor 332 may be directly or indirectly attached and/or coupled to motor 330 by one or more gears, connections, axles, or the like (not shown) to impart the operations and functions (e.g., motions) described herein. In some non-limiting embodiments or aspects, rotor 332 may be coupled to and/or engaged with cleaning pad 307, e.g., to actuate the movement (e.g., extension and/or retraction) of cleaning pad 307 with respect to housing 305 of robotic cleaner 300. For example, cleaning pad 307 may include and/or define a first (e.g., upper) surface 307*a* that is attached to cleaning element 301 and/or facing the underside of housing 305. Cleaning pad 307 may also include and/or define a second (e.g., bottom) surface 307*b* configured to contact and/or clean a designated surface along which robotic cleaner 300 travels.

Figure 3E:
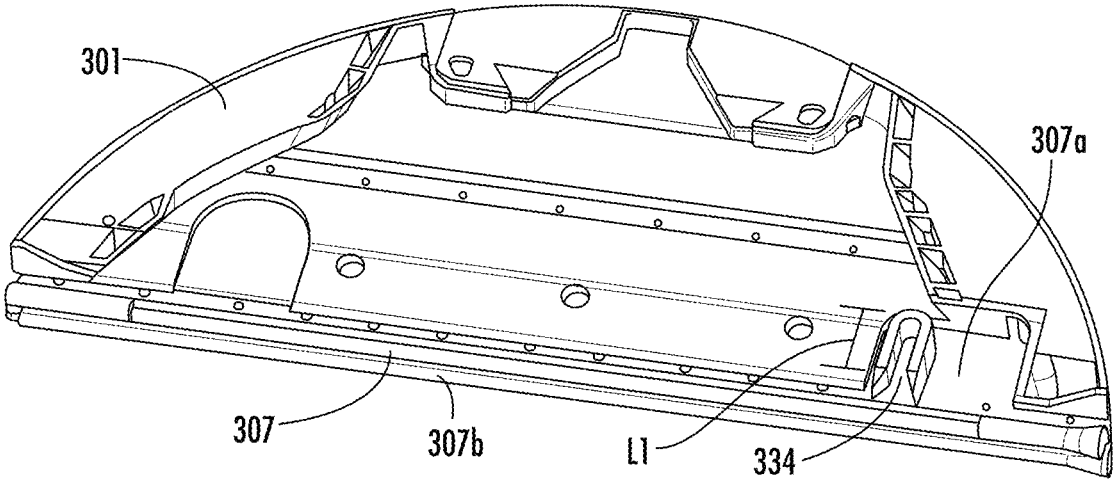
FIG. 3E is a top perspective view of a cleaning element of the robotic cleaner of FIG. 3B in a primary configuration.
Figure 3F:
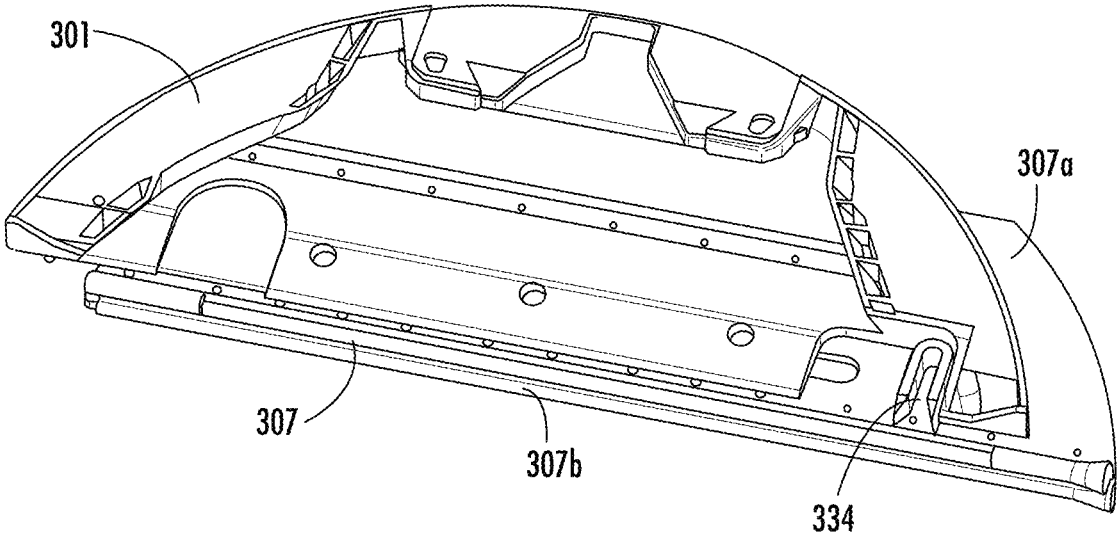
FIG. 3F is a top perspective view of the cleaning element of FIG. 3E in a secondary configuration.
Figure 3G:
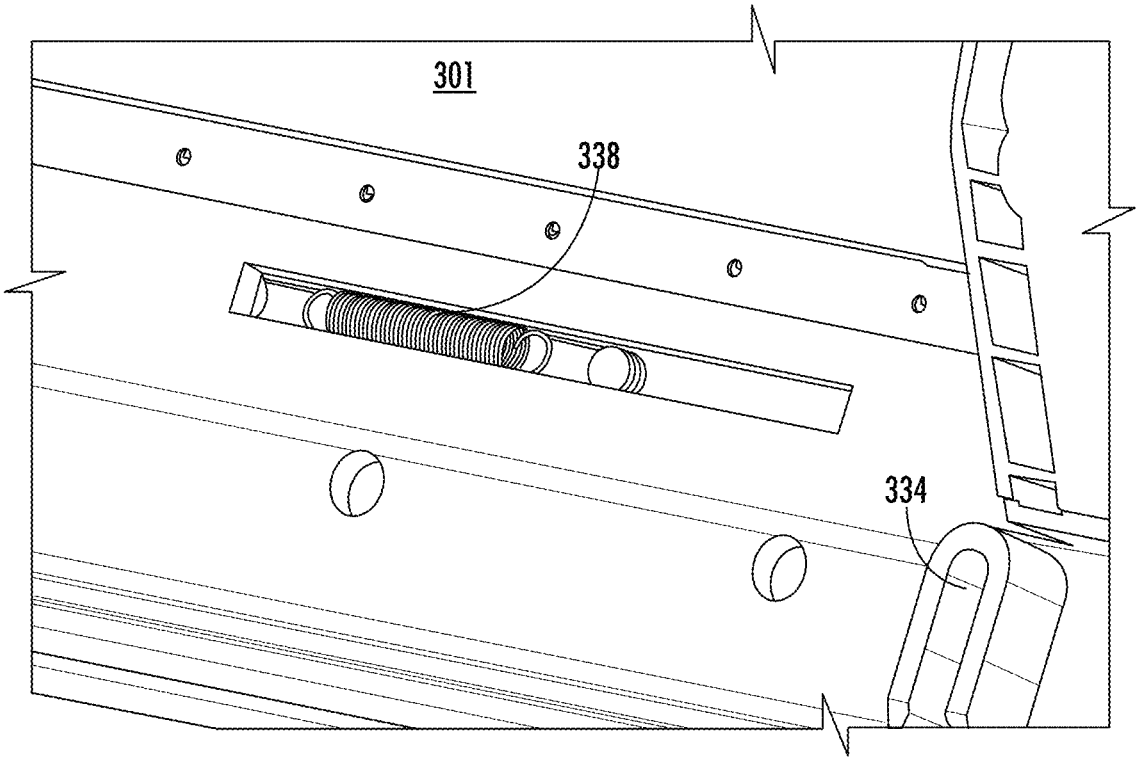
FIG. 3G is a close up view of a portion of the cleaning element of FIG. 3E.

In some non-limiting embodiments or aspects, first (e.g., upper) surface 307*a* of cleaning pad 307 may include and/or define recess 334 (e.g., a slot, a groove, and/or the like) that may engage with and/or otherwise receive protrusion 336 on rotor 332. For example, recess 334 may be defined by a slot in upper surface 307*a* and/or may be defined by a raised sidewall surrounding and defining at least a portion of a groove, e.g., as shown in FIGS. 3E-3F. In some non-limiting embodiments or aspects, recess 334 may define an elongated length L1, e.g., in a direction substantially perpendicular and/or transverse to axis A1 defining the direction of movement of cleaning pad 307 with respect to the housing 305 and/or cleaning element 301.

With continued reference to FIGS. 3E-3F, an example of a range and direction of movement of cleaning pad 307 is illustrated. In some non-limiting embodiments or aspects, cleaning pad 307 may be movably attached to cleaning element 301, which, in turn, may be releasably attachable to housing 305 of robotic cleaner 300, as described herein. The movable attachment between cleaning pad 307 and cleaning element 301 may be achieved through one or more tracks, bearings, grooves, tabs, telescoping arrangements, and/or otherwise to provide the movement and controllability described herein.

In some non-limiting embodiments or aspects, cleaning pad 307 may have a first (e.g., non-extended) position (e.g., as shown in FIG. 3E), where cleaning pad 307 may be substantially aligned with and/or underlying with cleaning element 301. Additionally or alternatively cleaning pad 307 may have a second (e.g., extended) position (e.g., as shown in FIG. 3F), where cleaning pad 307 extends laterally along axis A1 to protrude and/or otherwise reach beyond the perimeter and/or edge of the cleaning element 301 and/or housing 305. For example, with reference to FIG. 3G, biasing element 338 (e.g., a spring, elastic band, and/or the like) may be attached to cleaning pad 307 and/or cleaning element 301 to bias cleaning pad 307 towards the first (e.g., non-extended) position.

Figure 3H:
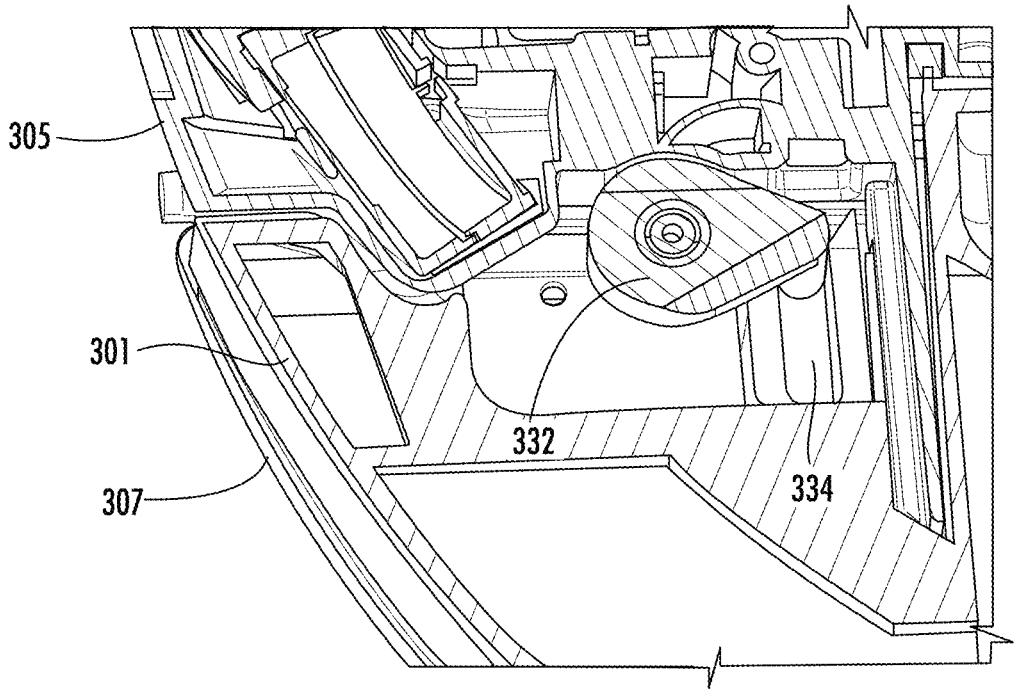
FIGS. 3H-3K are cross-sectional views of a portion of the robotic cleaner of FIG. 3B illustrating varying configurations and positions of the cleaning element shown in FIGS. 3E-3F.

Referring now to FIGS. 3H-3K, various stages of movement between housing 305, rotor 332, and cleaning pad 307 are illustrated. In some non-limiting embodiments or aspects, as shown in FIG. 3H, protrusion 336 of rotor 332 may be at least partially positioned within recess 334, and cleaning pad 307 may be in the first (e.g., non-extended) position that may be substantially aligned with housing 305 of robotic cleaner 300 (e.g., the edges of cleaning pad 307 may substantially align with the outer edges and/or perimeter of housing 305).

Figure 3I:
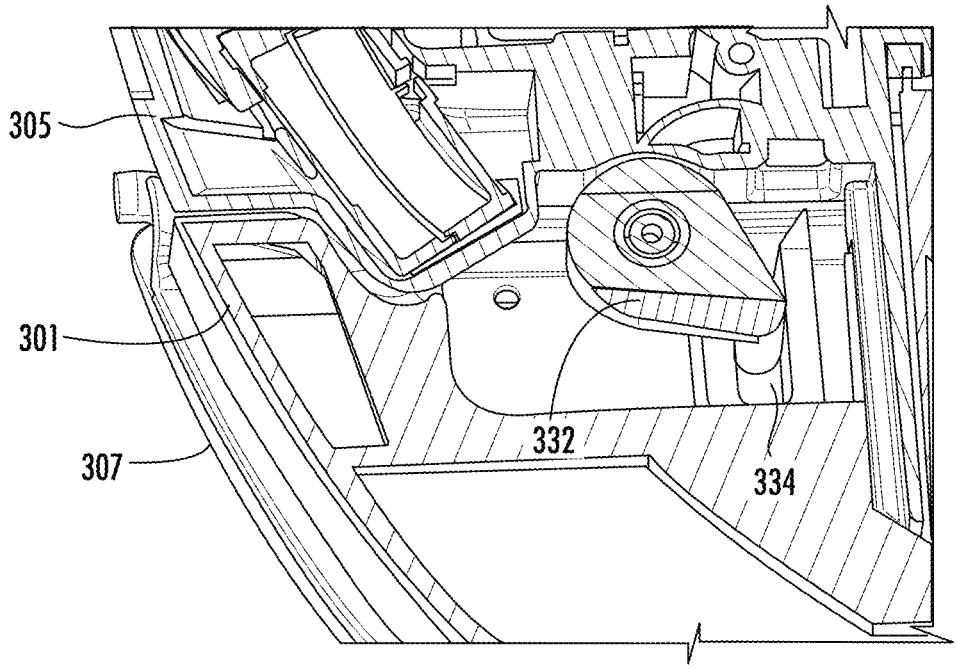

In some non-limiting embodiments or aspects, as shown in FIG. 3I, motor 330 may rotate rotor 332, which may cause protrusion 336 to travel down recess 334 while moving cleaning pad 307 outward/laterally such that at least a portion of cleaning pad 307 extends away from and/or beyond the edges and/or perimeter of housing 305. The rotational movement of rotor 332 imparted by motor 330 may result in the linear translation and/or movement of cleaning pad 307 along first axis A1 with respect to housing 305.

Figure 3J:
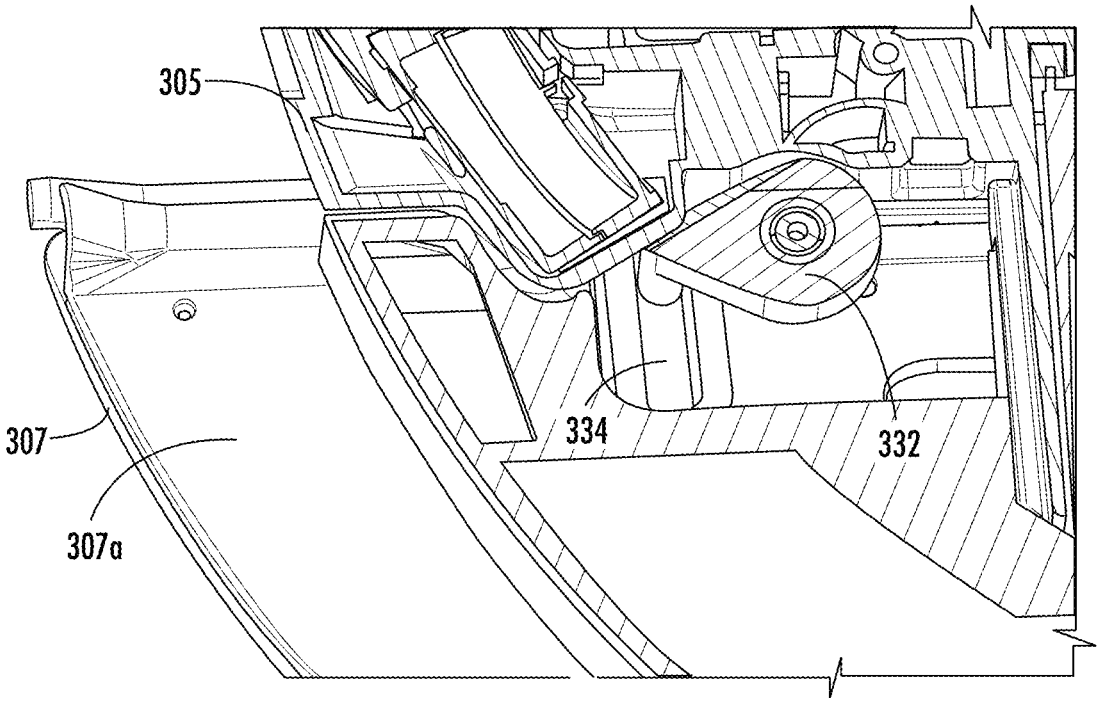

In some non-limiting embodiments or aspects, as shown in FIG. 3J, rotor 332 may have rotated approximately 180 degrees from the initial position (e.g., as shown in FIG. 3H), and cleaning pad 307 now may be in the second position (e.g., fully extended) with respect to housing 305.

Figure 3K:
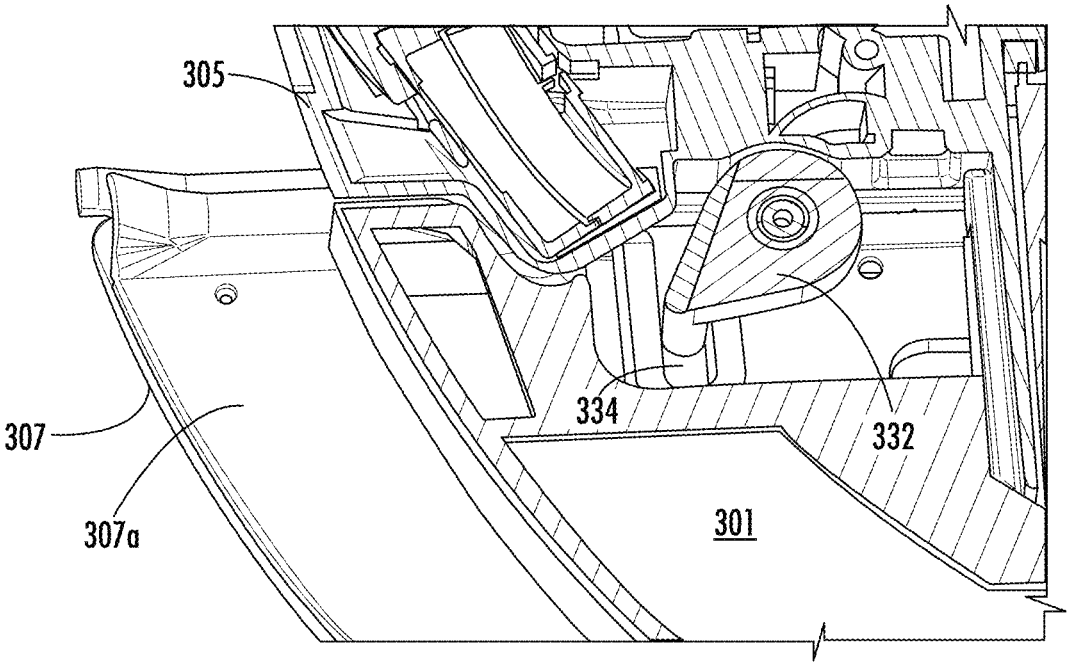

In some non-limiting embodiments or aspects, as shown in FIG. 3K, rotor 332 may have been partially rotated in the reverse direction, e.g., to partially retract cleaning pad 307 from the second position. For example, returning rotor 332 to the original rotational position (e.g., as shown in FIG. 3H) may return cleaning pad 307 to the original first (e.g., non-extended) position.

In some non-limiting embodiments or aspects, the length and/or relative distance that cleaning pad 307 extends from cleaning element 301 and/or housing 305 may be modified and/or selected for a particular application by modifying one or more characteristics of motor 330, rotor 332, housing 305, cleaning element 301, and/or cleaning pad 307, including but not limited to, size, shape, linkage, movement mechanisms, and/or the like. In some non-limiting embodiments or aspects, the range of movement of cleaning pad 307 may correspond with (e.g., be equal to, be substantially equal to, be slightly less than, and/or the like) wall follow distance d1, offset width d2 between cleaning pad 307 and housing 305, and/or combined width d3, any of which may be predefined and/or pre-programmed into a controller or processor operating one or more aspects of robotic cleaner 300. The size and extension range of the cleaning pad 307 may, for example, be substantially equal to the width d3 to maximize the surface area cleaned and/or treated by cleaning pad 307.

Figure 4:
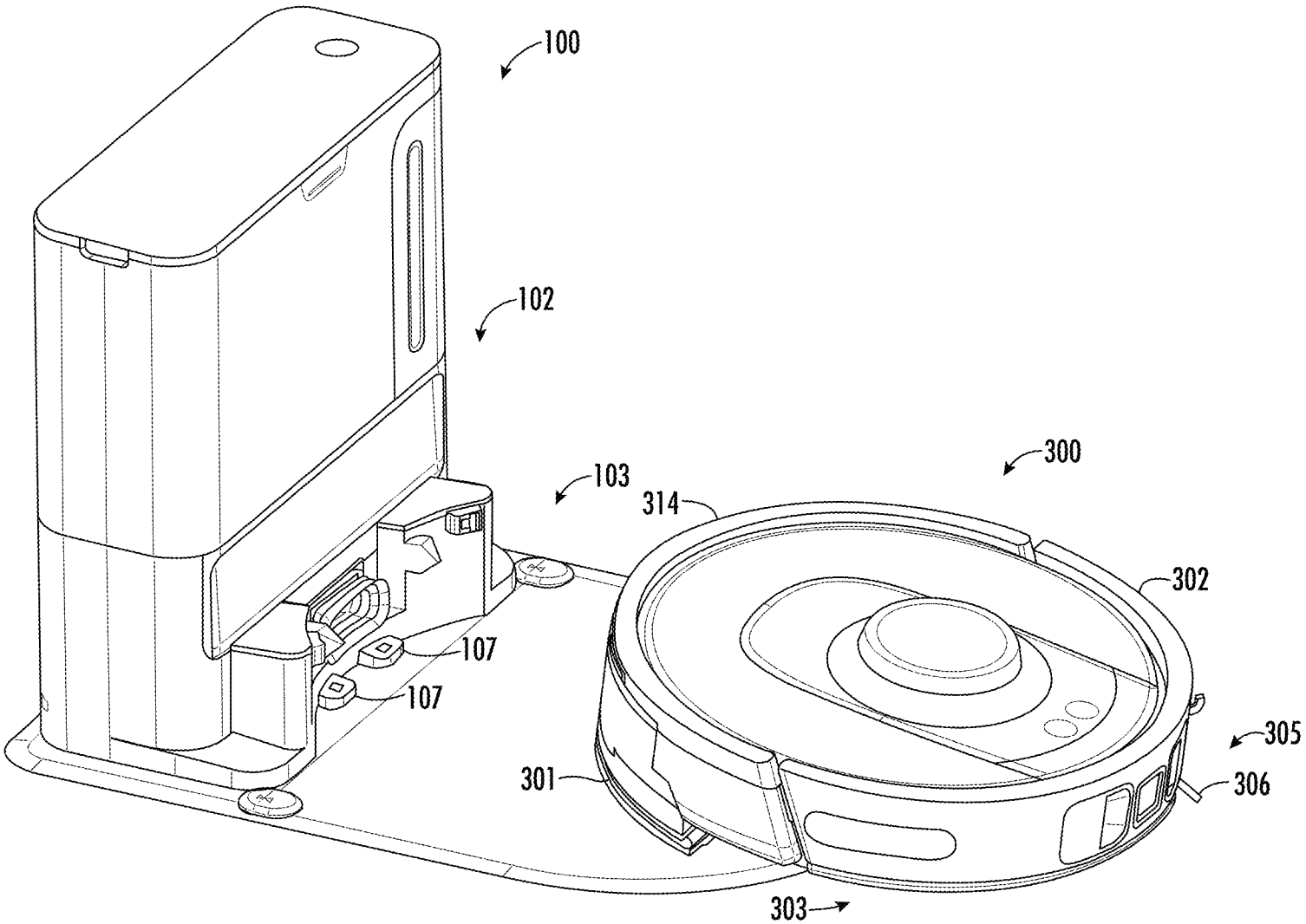
FIG. 4 is a front perspective view of a robotic cleaner relative to a docking station, according to non-limiting embodiments or aspects of the present disclosure.

Referring now to FIG. 4, FIG. 4 is a front perspective view of robotic cleaner 300 relative to docking station 100, according to non-limiting embodiments or aspects of the present disclosure. As shown in FIG. 4, robotic cleaner 300 has wet cleaning element 301 attached to underside 303 of robotic cleaner 300. As depicted, robotic cleaner 300 may be departing from docking station 100 to engage in cleaning operation, resting on support 103 of docking station 100, or returning to dock with docking station 100. For a docking maneuver, robotic cleaner 300 may approach docking station 100 and travel along support 103 toward base 102 of docking station 100. As such, robotic cleaner 300 may dock with docking station 100 (e.g., make final connection with docking stops 112, 124, charging contacts 110, detents 107, cleaning fluid conduit 132, boot 109, etc.). If robotic cleaner 300 seeks to leave docking station 100, robotic cleaner 300 may travel away from base 102 of docking station 100.

Figure 5:
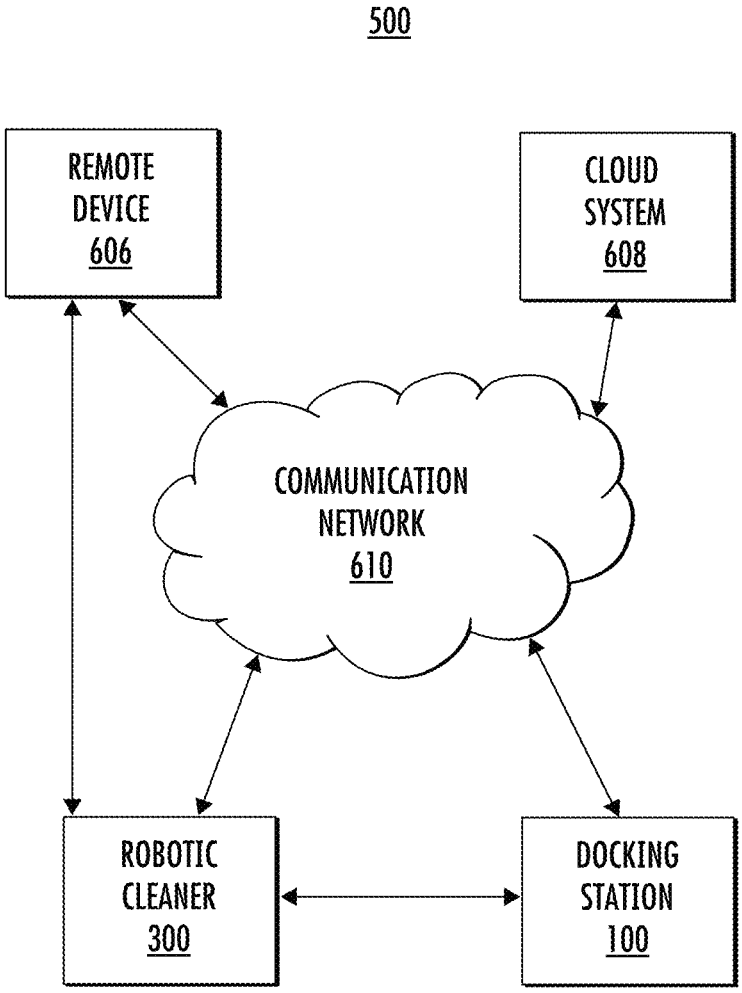
FIG. 5 is a diagram of a non-limiting embodiment or aspect of an environment in which systems, devices, products, apparatuses, and/or methods, described herein, may be implemented, according to the principles of the present disclosure.

Referring now to FIG. 5, FIG. 5 is a diagram of an example environment 500 in which devices, systems, and/or methods, described herein, may be implemented. As shown in FIG. 5, environment 500 may include remote device 606, cloud system 608, robotic cleaner 300, docking station 100, and communication network 610. Remote device 606, cloud system 608, robotic cleaner 300, and docking station 100 may interconnect (e.g., establish a connection to communicate) via one or more wired connections, wireless connections, or a combination of wired and wireless connections. In some non-limiting embodiments or aspects, environment 500 may further include external sensors, operational boundary devices, and/or the like.

Docking station 100 may include one or more computing devices configured to communicate with remote device 606, cloud system 608, and/or robotic cleaner 300 at least partly over communication network 610. Docking station 100 may be configured to monitor its operational parameters, such as the unused cleaning fluid level, used cleaning fluid level, debris tank status, docking status, robotic cleaner status, and/or the like. Docking station 100 may communicate with robotic cleaner 300 to determine when to extend or retract detents 107 electronically in support 103 of docking station 100, to allow the conversion from wet mode to dry mode operation and vice versa, in certain electronic-controlled embodiments or aspects.

Robotic cleaner 300 may include one or more computing devices configured to communicate with remote device 606, cloud system 608, and/or docking station 100 at least partly over communication network 610. Robotic cleaner 300 may be configured to autonomously carry out cleaning operations in wet mode or dry mode, and may further autonomous convert between those modes in concert with docking station 100. Robotic cleaner 300 may communicate with remote device 606 to determine an operational mode and relay parameters of robotic cleaner's 300 operations to remote device 606, including an operational mode status. Robotic cleaner 300 may further communicate with cloud system 608 to relay operational parameters, including cleaning statuses, operational modes, obstacles detected, errors, failures, obstacles, and/or the like. Robotic cleaner 300 may further communicate with docking station 100 to cause docking station to extend or retract detents 107, in certain electronic-controlled embodiments or aspects.

Remote device 606 may include one or more computing devices configured to communicate with cloud system 608, robotic cleaner 300, and/or docking station 100 at least partly over communication network 610. Remote device 606 may be configured to instruct robotic cleaner 300 to change modes of operation and carry out docking or undocking procedures. Remote device 606 may further communicate with robotic cleaner 300 to receive status updates and parameters of cleaning operation. Remote device 606 may communicate with cloud system to view historical and real-time operation parameters of robotic cleaner 300. Remote device 606 may further communicate with docking station 100 to receive parameters and status information of docking station 100 operation.

Cloud system 608 may include one or more computing devices configured to communicate with remote device 606, robotic cleaner 300, and/or docking station 100 at least partly over communication network 610. Cloud system 608 may be configured to receive operational information from robotic cleaner 300 and/or docking station 100 and store at least some of the information in memory. Cloud system 608 may communicate with remote device 606 to transmit at least a portion of real-time or stored operational information that is received from robotic cleaner 300 and/or docking station 100. Cloud system 608 may further store cleaning operation parameters and preferences for a cleaning system and/or user. Cloud system 608 may communicate operation instructions to robotic cleaner 300.

Communication network 610 may include one or more wired and/or wireless networks over which the systems and devices of environment 500 may communicate. For example, communication network 610 may include a cellular network (e.g., a long-term evolution (LTE®) network, a third generation (3G) network, a fourth generation (4G) network, a fifth generation (5G) network, a code division multiple access (CDMA) network, etc.), a public land mobile network (PLMN), a local area network (LAN), a wide area network (WAN), a metropolitan area network (MAN), a telephone network (e.g., the public switched telephone network (PSTN)), a private network, an ad hoc network, an intranet, the Internet, a fiber optic-based network, a cloud computing network, and/or the like, and/or a combination of these or other types of networks.

The number and arrangement of devices and networks shown in FIG. 5 are provided as an example. There may be additional devices and/or networks, fewer devices and/or networks, different devices and/or networks, or differently arranged devices and/or networks than those shown in FIG. 5. Furthermore, two or more devices shown in FIG. 5 may be implemented within a single device, or a single device shown in FIG. 5 may be implemented as multiple, distributed devices. Additionally or alternatively, a set of devices (e.g., one or more devices) of environment 500 may perform one or more functions described as being performed by another set of devices of environment 500.

Figure 6:
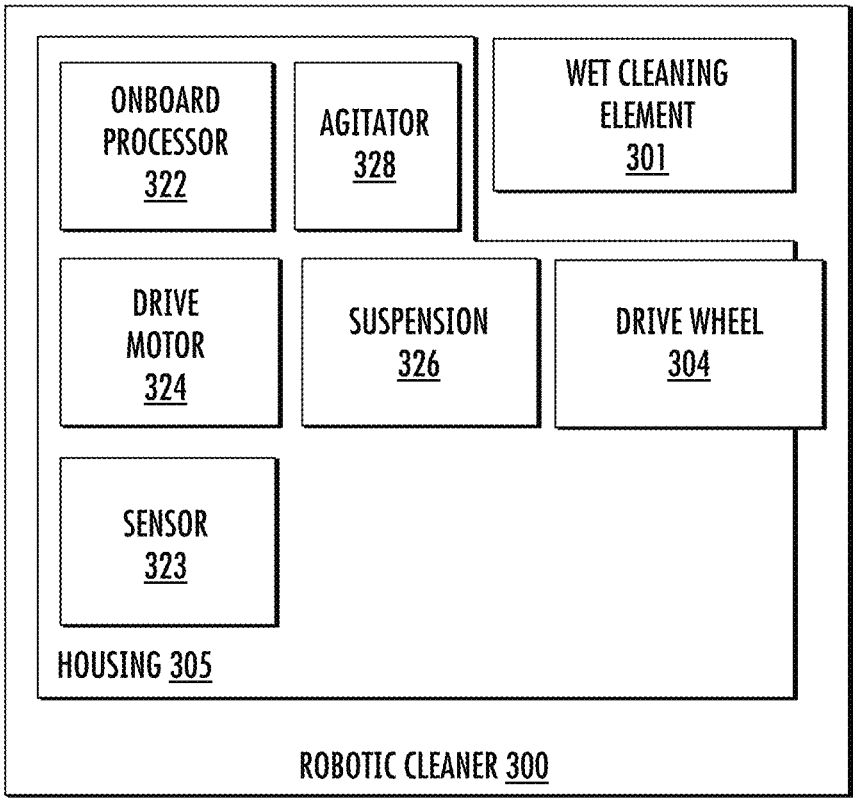
FIG. 6 is a schematic diagram of a robotic cleaner, according to non-limiting embodiments or aspects of the present disclosure.

Referring now to FIG. 6, FIG. 6 is a schematic diagram of robotic cleaner 300, according to some non-limiting embodiments or aspects. Robotic cleaner 300 may include housing 305 generally defining the body of robotic cleaner 300. Housing 305 may include controls (e.g., buttons) on a top surface of housing 305, to initiate certain operations, including, but not limited to, autonomous cleaning, spot cleaning, docking, and/or the like. Housing 305 may further include indicators (e.g., light emitting diodes (LEDs)) to indicate operations, battery charge levels, errors, and other information. Housing 305 may further include device components for carrying out cleaning operations, including, but not limited to, suction conduit, agitators 328, air jet assemblies, suction motor, clean air outlets, air outlet ports, fan outlets, clean air exhaust ducts, exhaust ducts, sensors 323 (e.g., bump sensors (e.g., associated with displaceable bumper 302), wall sensors, cliff sensors, internal ducting, any sensor described herein, and/or the like). Robotic cleaner 300 may include at least one sensor 323. For example, sensor(s) 323 may be mounted to and/or incorporated into robotic cleaner 300 (e.g., housing 305 thereof). For the purpose of illustration, at least one sensor 323 may be included on a front of robotic cleaner 300. In some non-limiting embodiments or aspects, sensor(s) 323 may include at least one of a camera; a color camera; a red, green, and blue (RGB) camera; a three-dimensional camera; an red, green, blue, and depth (RGB-D) camera; a light emitter; a light detector; an infrared (IR) camera; a spectrometer; an IR spectrometer; an image capture device; a LiDAR device; any combination thereof; and/or the like. Additionally or alternatively, sensor data may include at least one of an image, a video, a color image, an RGB image, a three-dimensional image, an RGB-D image, an IR image, spectroscopy data, IR spectroscopy data, reflectance data, specular reflectance data, diffuse reflectance data, color data, texture data, any combination thereof, and/or the like. In some non-limiting embodiments or aspects, reflectance data (e.g., specular and/or diffuse reflectance data) may be obtained using multiple incident angles and/or multiple wavelengths of light emitted from sensor 323.

Housing 305 may include and/or be mechanically coupled to suspension 326 that is adjustable to raise and lower a clearance profile of housing 305 from the surface to be cleaned (e.g., floor). The other end of suspension 326 may be mechanically coupled with one or more wheels for conveying robotic cleaner 300 across the surface to be cleaned, which may include one or more drive wheels 304. One or more drive wheels 304 may extend at least partially outside of housing 305. The mechanical power for propelling robotic cleaner 300 across the surface to be cleaned may be provided by one or more drive motors 324, which may draw electrical power from one or more batteries stored onboard robotic cleaner 300, such as in housing 305. In some non-limiting embodiments or aspects, one or more drive wheels 304 may be partially housed in and partially extend from housing 305 to contact the surface to be cleaned.

Robotic cleaner 300 may further include one or more wet cleaning elements 301 that are configured to be removably attached from housing 305. When robotic cleaner 300 is in a wet mode of operation (e.g., mopping), one or more wet cleaning elements 301 may be attached to an underside 303 of robotic cleaner 300, and each wet cleaning element 301 may include a cleaning pad 307 (e.g., a mop pad) for contacting and cleaning the surface to be cleaned. Robotic cleaner 300 may include an onboard tank for cleaning solution, which may be delivered to cleaning pad 307 via conduit at least partially within housing 305 from the onboard tank to the cleaning pad 307. One or more wet cleaning elements 301 may each include an engaging surface 320 configured to interface with and contact one or more detent 107 of docking station 100, to allow wet cleaning elements 301 to be detached from housing 305 of robotic cleaner 300.

Robotic cleaner may further include one or more agitators 328 that are configured to carry out a dry mode of operation (e.g., vacuuming). For example, agitator 328 may include a rotating agitator including bristles, fabric, or other cleaning elements, or any combination thereof, around the outside of agitator 328. A rotating agitator 328 may include, for example, strips of bristles in combination with strips of rubber or elastomer material. A rotating agitator 328 may also be removable to allow the rotating agitator 328 to be cleaned more easily and allow the user to change the size of the rotating agitator 328, change the type of bristles on the rotating agitator 328, and/or remove the rotating agitator 328 depending on the intended application. Robotic cleaner 300 may further include, as an agitator 328, a bristle strip on an underside of housing 305 and adjacent a portion of suction conduit, to contact the surface to be cleaned and urge debris toward the suction conduit of robotic cleaner 300. In some non-limiting embodiments or aspects, one or more agitators 328 may be used in concert with at least one wet cleaning element 301 for carrying out wet mode operation of robotic cleaner 300. Additionally or alternatively, one or more agitators 328 may be at least partially disabled, occluded, covered, and/or the like, by at least one wet cleaning element 301 when robotic cleaner 300 is in a wet mode of operation.

Robotic cleaner 300 may further include onboard processor 322 (e.g., a controller). Onboard processor 322 may be communicatively connected to sensors of robotic cleaner 300 (e.g., bump sensors, wheel drop sensors, rotation sensors, forward obstacle sensors, side wall sensors, cliff sensors, etc.) and to driving mechanisms (e.g., drive motor 324, motors configured to control one or more features of an air jet assembly, agitator 328 assembly, side brush 306, etc.). Thus, onboard processor 322 may be configured to operate one or more drive wheels 304, air jet assemblies, agitators 328, motor 330, rotor 332, etc., in response to sensed conditions. Onboard processor 322 may operate robotic cleaner 300 to perform various operations, such as autonomous cleaning (e.g., including randomly moving and turning, wall following, obstacle following, etc.), spot cleaning, and docking. Onboard processor 322 may also operate robotic cleaner 300 to avoid obstacles and cliffs and to escape from various situations where robotic cleaner 300 may become stuck. Onboard processor 322 may include one or more hardware components, such as described in FIG. 7.

Figure 7:
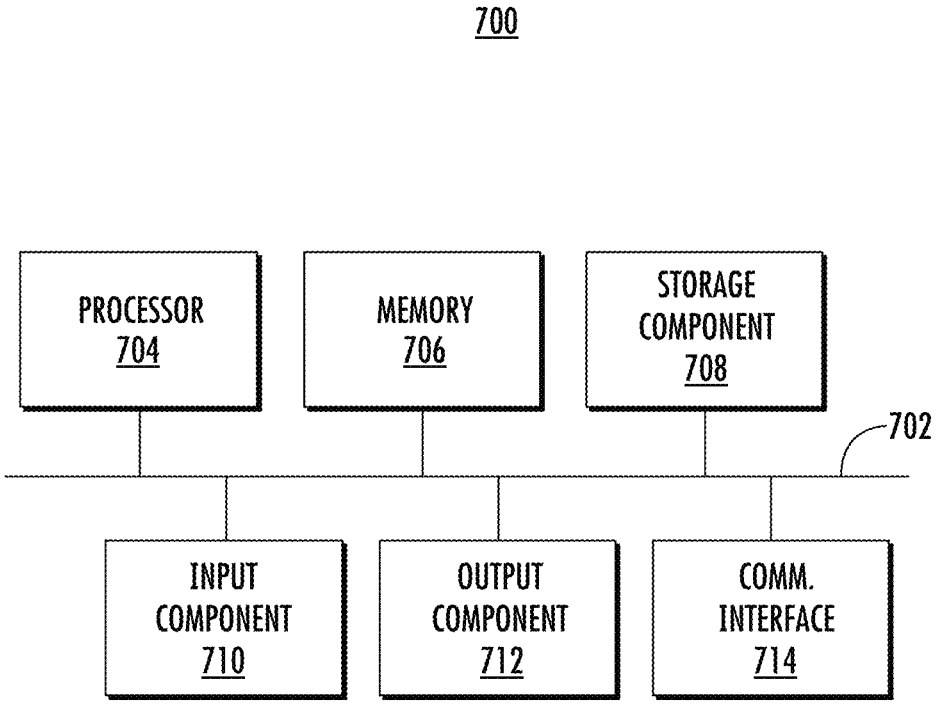
FIG. 7 is a diagram of one or more components, devices, and/or systems, according to some non-limiting embodiments or aspects.

Referring now to FIG. 7, FIG. 7 is a diagram of example components of device 700 according to some non-limiting embodiments or aspects. Device 700 may correspond to one or more devices of docking station 100, robotic cleaner 300, remote device 606, cloud system 608, and/or communication network 610 as shown in FIG. 5, or onboard processor 322 or robotic cleaner 300 as shown in FIG. 6. In some non-limiting embodiments or aspects, such systems or devices may include at least one device 700 and/or at least one component of device 700.

As shown in FIG. 7, device 700 may include bus 702, processor 704, memory 706, storage component 708, input component 710, output component 712, and communication interface 714. Bus 702 may include a component that permits communication among the components of device 700. In some non-limiting embodiments or aspects, processor 704 may be implemented in hardware, firmware, or a combination of hardware and software. For example, processor 704 may include a processor (e.g., a central processing unit (CPU), a graphics processing unit (GPU), an accelerated processing unit (APU), etc.), a microprocessor, a digital signal processor (DSP), and/or any processing component (e.g., a field-programmable gate array (FPGA), an application-specific integrated circuit (ASIC), etc.) that can be programmed to perform a function. Memory 706 may include random access memory (RAM), read only memory (ROM), and/or another type of dynamic or static storage device (e.g., flash memory, magnetic memory, optical memory, etc.) that stores information and/or instructions for use by processor 704.

Storage component 708 may store information and/or software related to the operation and use of device 700. For example, storage component 708 may include a hard disk (e.g., a magnetic disk, an optical disk, a magneto-optic disk, a solid state disk, etc.) and/or another type of computer-readable medium.

Input component 710 may include a component that permits device 700 to receive information, such as via user input (e.g., a touch screen display, a keyboard, a keypad, a mouse, a button, a switch, a microphone, etc.). Additionally or alternatively, input component 710 may include a sensor for sensing information (e.g., a global positioning system (GPS) component, an accelerometer, a gyroscope, an actuator, etc.). Output component 712 may include a component that provides output information from device 700 (e.g., a display, a speaker, one or more light-emitting diodes (LEDs), etc.).

Communication interface 714 may include a transceiver-like component (e.g., a transceiver, a separate receiver and transmitter, etc.) that enables device 700 to communicate with other devices, such as via a wired connection, a wireless connection, or a combination of wired and wireless connections. Communication interface 714 may permit device 700 to receive information from another device and/or provide information to another device. For example, communication interface 714 may include an Ethernet interface, an optical interface, a coaxial interface, an infrared interface, a radio frequency (RF) interface, a universal serial bus (USB) interface, a Wi-Fi® interface, a cellular network interface, and/or the like.

Device 700 may perform one or more processes described herein. Device 700 may perform these processes based on processor 704 executing software instructions stored by a computer-readable medium, such as memory 706 and/or storage component 708. A computer-readable medium (e.g., a non-transitory computer-readable medium) is defined herein as a non-transitory memory device. A memory device includes memory space located inside of a single physical storage device or memory space spread across multiple physical storage devices.

Software instructions may be read into memory 706 and/or storage component 708 from another computer-readable medium or from another device via communication interface 714. When executed, software instructions stored in memory 706 and/or storage component 708 may cause processor 704 to perform one or more processes described herein. Additionally or alternatively, hardwired circuitry may be used in place of or in combination with software instructions to perform one or more processes described herein. Thus, embodiments or aspects described herein are not limited to any specific combination of hardware circuitry and software. The term "programmed or configured," as used herein, refers to an arrangement of software, hardware circuitry, or any combination thereof on one or more devices.

The number and arrangement of components shown in FIG. 7 are provided as an example. In some non-limiting embodiments or aspects, device 700 may include additional components, fewer components, different components, or differently arranged components than those shown in FIG. 7. Additionally or alternatively, a set of components (e.g., one or more components) of device 700 may perform one or more functions described as being performed by another set of components of device 700.

Figure 8:
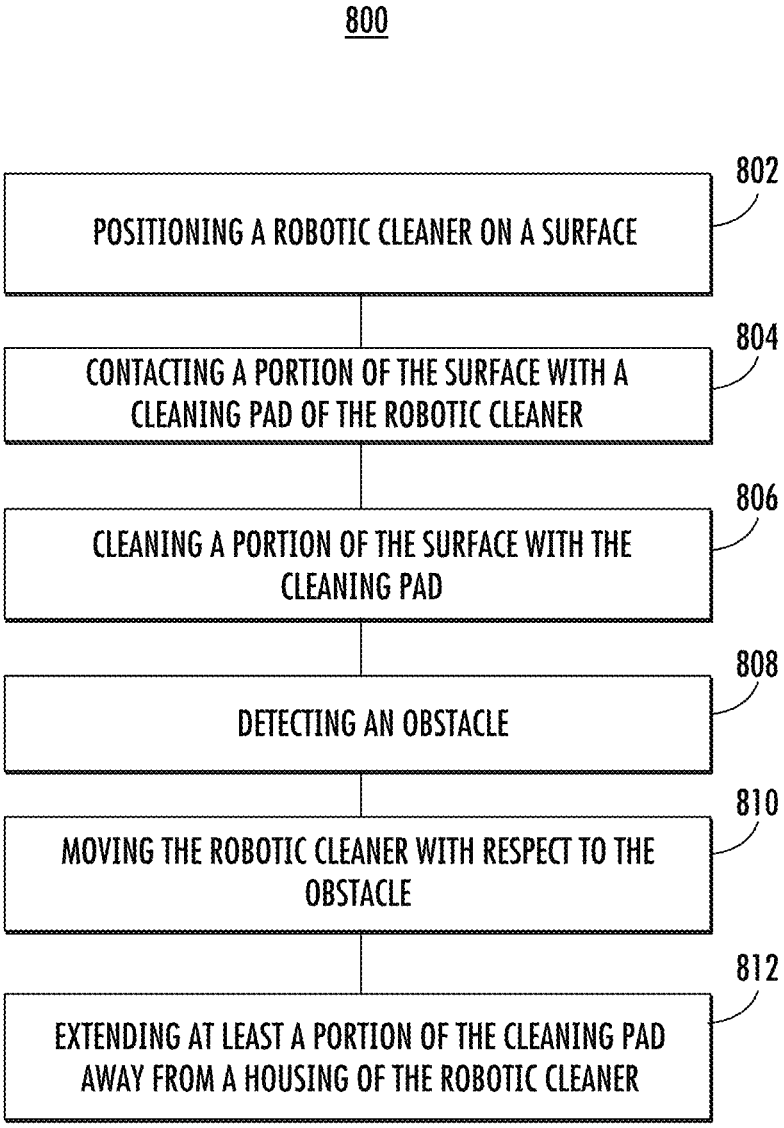
FIG. 8 is a flowchart of a method for operating a robotic cleaner, according to some non-limiting embodiments or aspects.

Referring now to FIG. 8, FIG. 8 is a flowchart of an example process 800 of operating and/or using a robotic cleaner, according to some non-limiting embodiments or aspects.

As shown in FIG. 8, at step 802, process 800 may include positioning a robotic cleaner on a surface. For example, robotic cleaner 300 may initially be positioned on or about a surface to be cleaned, as described herein.

As shown in FIG. 8, at step 804, process 800 may include contacting a portion of the surface with a cleaning pad of the robotic cleaner. For example, robotic cleaner 300 may be positioned and/or oriented such that cleaning pad 307 of robotic cleaner 300 contacts the surface to be cleaned, as described herein. During this initial positioning, cleaning pad 307 may be in the first, un-extended position described herein.

As shown in FIG. 8, at step 806, process 800 may include operating robotic cleaner 300 to clean a portion of the surface with the cleaning pad. For example, robotic cleaner 300 may autonomously move around the surface, vacuum or collect dirt or debris, dispense cleaning fluid, and/or the like.

As shown in FIG. 8, at step 808, process 800 may include detecting an obstacle in the proximity and/or travel path of robotic cleaner 300 may. For example, the obstacle may include a wall, piece of furniture, an edge or elevation change in the surface, etc. The obstacle detection may be performed at least in part with one or more of the components described herein (e.g., sensors 323, displaceable bumper 302, etc.).

As shown in FIG. 8, at step 810, process 800 may include moving the robotic cleaner 300 with respect to the obstacle. For example, robotic cleaner 300 may re-position and/or re-orient itself with respect to the detected obstacle. In some non-limiting embodiments or aspects, robotic cleaner 300 may reverse and/or rotate in place such that the path of extension of cleaning pad 307 is pointed at or near the detected obstacle.

As shown in FIG. 8, at step 812, process 800 may include extending at least a portion of cleaning pad 307 away from housing 305 of robotic cleaner. For example, cleaning pad 307 may be extended to its second position with respect to housing 305 of robotic cleaner 300, as described herein.

In some non-limiting embodiments or aspects, the extension (or retraction) of cleaning pad 307 may be facilitated and/or actuated by one or more of the controllers and/or processors in conjunction with motor 330 and rotor 332, as described herein. In some non-limiting embodiments or aspects, robotic cleaner 300 may continue moving about the surface and/or cleaning portions thereof with cleaning pad 307 in extended position (and/or in retracted position).

In some non-limiting embodiments or aspects, cleaning pad 307 may be at least partially extended and retracted while the robotic cleaner is stationary to provide additional surface agitation and/or cleaning in a particular location.

In some non-limiting embodiments or aspects, cleaning pad 307 may be at least partially extended and retracted while the robotic cleaner is moving about the surface in the absence of any obstacle detection as part of a stain removal and/or enhance cleansing protocol.

The steps shown in FIG. 8 are for illustrative purposes only. It will be appreciated that additional, fewer, different, and/or a different order of steps may be used in some non-limiting embodiments or aspects, one or more of the steps of process 800 may be performed (e.g., completely, partially, and/or the like) by robotic cleaner 300 (e.g., onboard processor 322 thereof), and/or one or more of the steps may be performed (e.g., completely, partially, and/or the like) by another system, another device, another group of systems, or another group of devices, separate from or including robotic cleaner 300, such as remote device 606, cloud system 608, and/or docking station 100.

While the principles of the disclosed subject matter have been described herein, it is to be understood by those skilled in the art that this description is made only by way of example and not as a limitation as to the scope of the disclosed subject matter. Other embodiments are contemplated within the scope of the presently disclosed subject matter in addition to the exemplary embodiments shown and described herein. Modifications and substitutions by one of ordinary skill in the art are considered to be within the scope of the presently disclosed subject matter, which is not to be limited except by the following claims.

What is claimed is:

1. A robotic cleaning system, comprising:
a robotic cleaner comprising:
a housing;
a cleaning pad movably attached to the housing, the cleaning pad being movable to extend at least a portion of the cleaning pad beyond an edge of the housing; and
a rotor coupled to a motor and the cleaning pad, wherein rotational movement of the rotor causes linear movement of the cleaning pad.

2. The system of claim 1, wherein the robotic cleaner further comprises the motor coupled to the housing, the motor configured to move the cleaning pad with respect to the housing.

3. The system of claim 1, wherein the cleaning pad defines a groove on a surface thereof, the groove configured to receive a portion of the rotor therein.

4. The system of claim 3, wherein the cleaning pad is movable in a substantially linear direction along a first axis with respect to the housing, and wherein the groove defines an elongated length substantially perpendicular to the first axis.

5. The system of claim 1, wherein the robotic cleaner further comprises a biasing element attached to the cleaning pad, the biasing element configured to bias the cleaning pad towards a first position with respect to the housing.

6. The system of claim 1, wherein the cleaning pad is releasably attached to the housing.

7. The system of claim 1, wherein the robotic cleaner further comprises:
at least one sensor; and
at least one processor programmed or configured to:
detect an obstacle based on information from the at least one sensor; and
actuate movement of the cleaning pad with respect to the housing.

8. The system of claim 7, wherein the at least one processor is programmed or configured to actuate movement of the robotic cleaner in response to detecting an obstacle.

9. The system of claim 8, wherein the at least one processor is programmed or configured to actuate movement of the cleaning pad with respect to the housing after actuating movement of the robotic cleaner in response to detecting an obstacle.

10. The system of claim 7, wherein the at least one processor is programmed or configured to actuate movement of the cleaning pad by sending a signal to a motor coupled to the cleaning pad.

11. The system of claim 1, further comprising:
a docking station comprising:
a base; and
a support extending laterally from the base, the support configured to receive at least a portion of the robotic cleaner on top of the support.

* * * * *